US005575554A

United States Patent [19]

Guritz

[11] Patent Number: 5,575,554

[45] Date of Patent: Nov. 19, 1996

[54] MULTIPURPOSE OPTICAL DISPLAY FOR ARTICULATING SURFACES

[76] Inventor: Steven P. W. Guritz, P.O. Box 10022, Portland, Oreg. 97120

[21] Appl. No.: 354,558

[22] Filed: Dec. 13, 1994

Related U.S. Application Data

[60] Division of Ser. No. 890,706, May 29, 1992, Pat. No. 5,375,044, which is a continuation-in-part of Ser. No. 698, 824, May 13, 1991, Pat. No. 5,128,843.

[51] Int. Cl.[6] ..... F21L 15/08

[52] U.S. Cl. ..... 362/103; 362/806

[58] Field of Search ..... 362/103, 108, 362/800, 806, 234

[56] References Cited

U.S. PATENT DOCUMENTS

| | | | |
|---|---|---|---|
| 4,164,008 | 8/1979 | Miller et al. | 362/806 X |
| 4,308,572 | 12/1981 | Davidson et al. | 362/103 |
| 4,602,191 | 7/1986 | Davila | 362/103 X |
| 4,709,307 | 11/1987 | Branom | 362/103 |
| 4,774,434 | 9/1988 | Bennion | 362/800 X |
| 5,375,044 | 12/1994 | Guritz | 362/103 X |

*Primary Examiner*—Stephen F. Husar
*Attorney, Agent, or Firm*—Milton S. Gerstein

[57] ABSTRACT

An optical display device for use with wearing apparel or in combination with novelty gifts for illumination thereof. The optical display device based upon a control circuit capable of energizing incandescent lamps attached to a conductive pathway. The control circuit having an IC based timing circuit with manual switches for lamp lighting mode sequence as well as sequencing speed. An alternative embodiment is disclosed using an EPROM IC chip wherein all sequencing and functional timing is performed by an instructional software program made operational upon manual switch toggling. The conductive pathway provides electrical coupling to the lamps with one embodiment having a pathway formed from flexible circuit boards. Use of flexible circuit boards permits simplistic color changing by use of peel-off covers placed over the lamps as well as protection from moisture, impact, or dislodgement of the lamps. The coupling of circuit boards across movable joints is by flexible wire or conductor tape. Placement of the flexible circuit boards on the active limbs of a body in motion enhances the optical display thereby illuminating the wearer for ornamental or safety purposes. Alternative to the circuit board is the use of a conductive ink, preferably silver, which is directly impregnated onto the object. Conductive ink is especially suitable for wearing apparel such as t-shirts wherein a silk screen is used for background and the lamps highlight the design.

9 Claims, 15 Drawing Sheets

FIG. 4
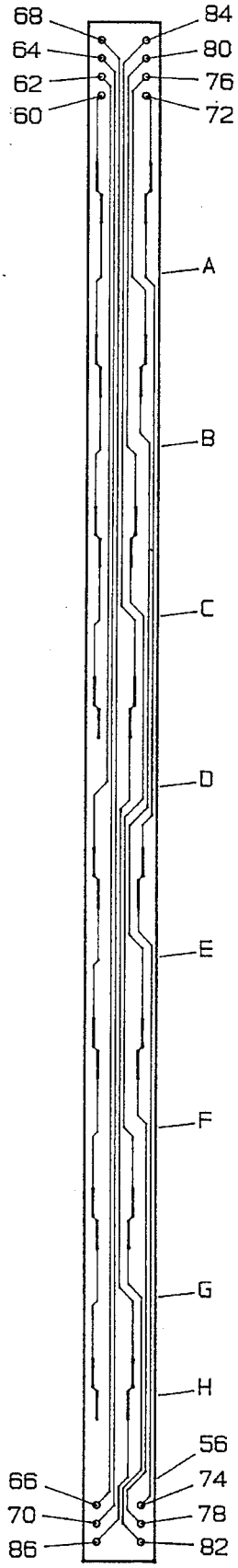
FIG. 5
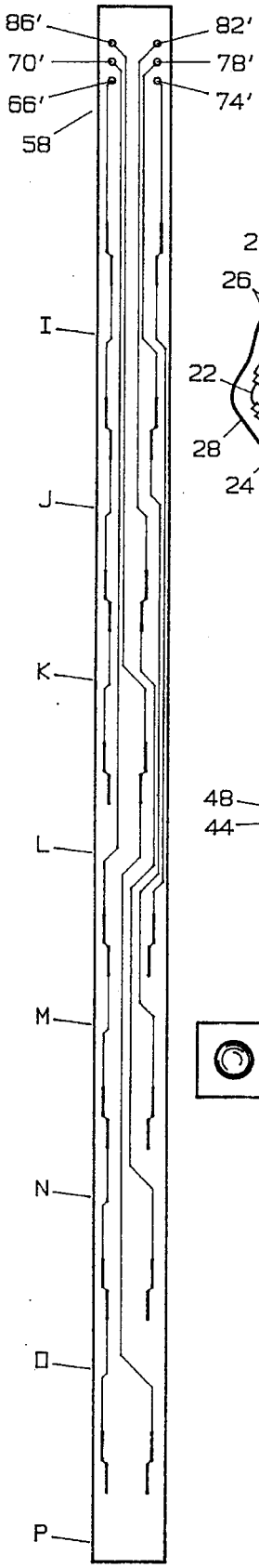
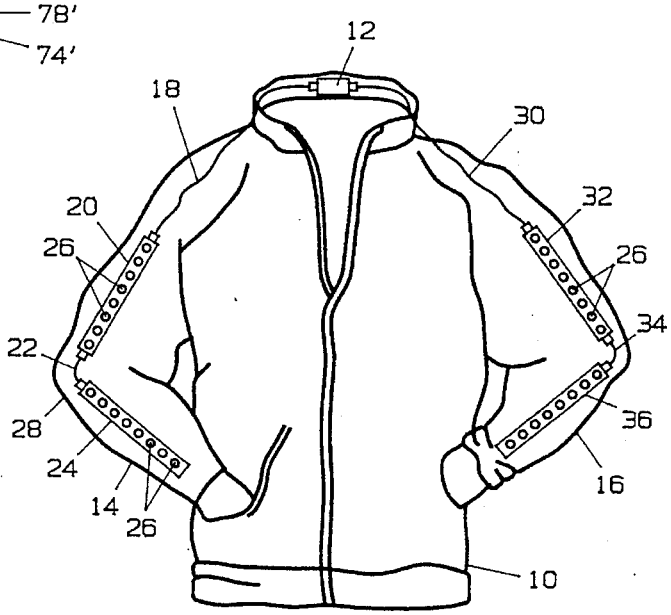
FIG. 1
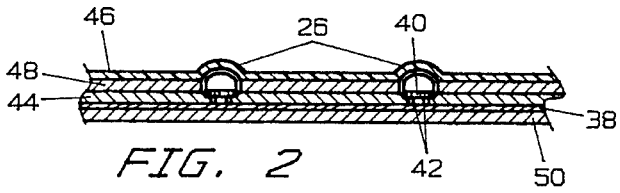
FIG. 2
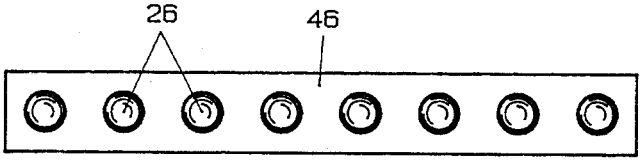
FIG. 3
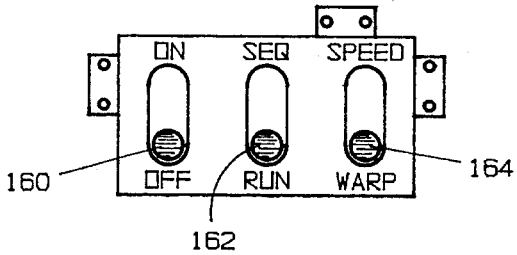
FIG. 11

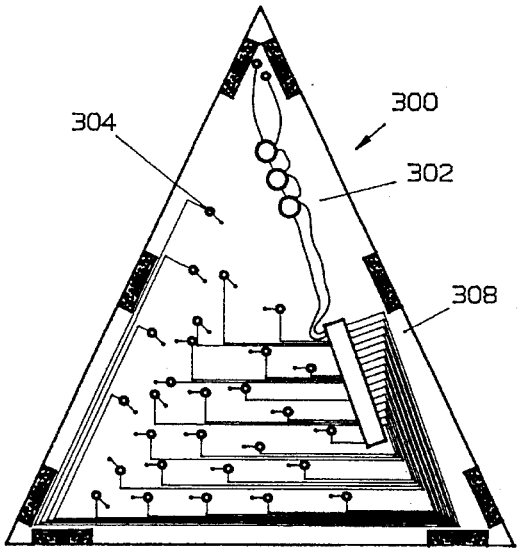
FIG. 29
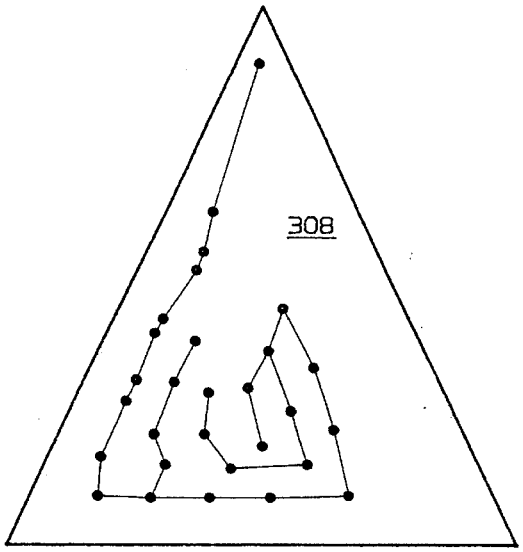
FIG. 30
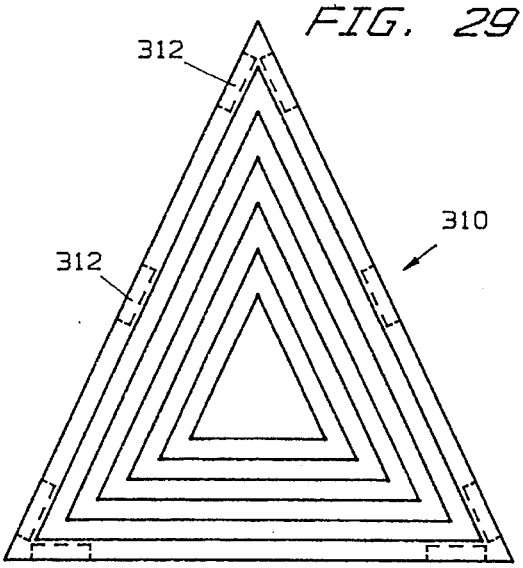
FIG. 31
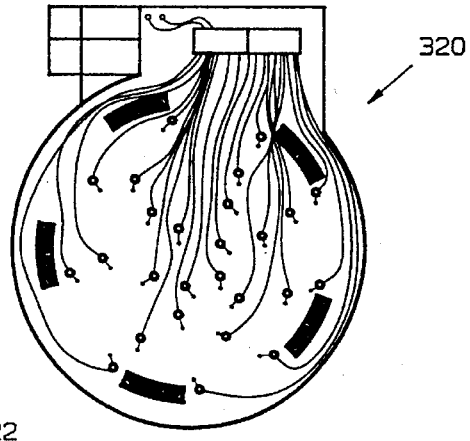
FIG. 32
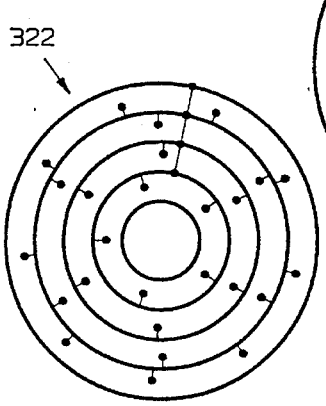
FIG. 33
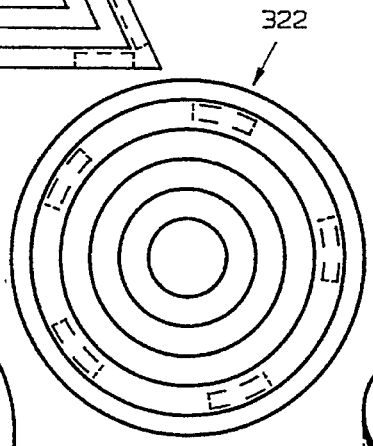
FIG. 34
FIG. 35
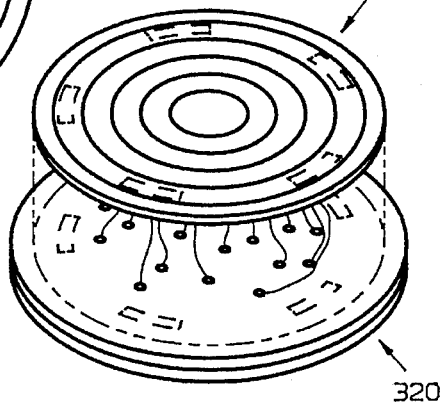

MULTIPURPOSE OPTICAL DISPLAY FOR ARTICULATING SURFACES

CROSS REFERENCE TO RELATED APPLICATION

This is a divisional of application Ser. No. 07/890,706, filed on May 29, 1992, now U.S. Pat. No. 5,375,044, which application is a continuation-in-part of application Ser. No. 07/698,824, filed on May 13, 1991, now U.S. Pat. No. 5,128,843.

BACKGROUND OF THE INVENTION

This invention relates generally to portable optical display devices used on wearing apparel, and, more particularly, to a multi-purpose optical display device employing sealed incandescent lamps suitable for use across any flat or articulating surface found on wearing apparel.

The use of optical display devices on wearing apparel to achieve an ornamental effect is well known. Typically these devices consist of several miniaturized components such as a portable power supply, a control circuit, and the optical display. Locally mounting of the power supply allows the operator to energize the display without further need of electrical coupling. Use of a control circuit provides power management to control cyclical flashing, continuous lighting, or simply provide an interface for power distribution. Optical displays of known prior art include low current drawing components such as light emitting diodes (LED's) and miniaturized lamps.

As with any electrical application, the correct selection of electrical components is a necessity. However, use of electrical components on wearing apparel raises unique problems. For instance, electrical components located on apparel are subjected to moisture, such as chemical cleaning, and must be removed or made water resistant if the device is to remain operable. Even naturally accruing moisture may corrode connectors leading to their eventual failure. In addition, components used on wearing apparel must be lightweight, comfortable, allow freedom of movement, and look well if consumer expectations are to be met.

The prior art has only addressed the problem of moisture. For instance, is found in U.S. Pat. No. 4,570,206 by Deutsch, an optical display is releasably attached by placement of the components in a patch-like pouch. The pouch is located inside a garment requiring all display lights to be inserted through logistically placed garment openings. Before garment washing, the lights are pulled from their respectful openings and the electrical circuitry removed from the pouch. Another such device is described in U.S. Pat. No. 4,709,307 by Branom, whose optical light source is placed within a pocket formed on a garment. Yet another optical device is described in U.S. Pat. No. 4,602,191 by Davila whose optical display is placed on the inside of a jacket using a hook and loop pile fastener. All the previously mentioned devices use rigid circuit boards to hold the optical display, the circuit board is then removed before washing.

While the prior art acknowledges moisture problems, the art does not address the remaining previously mentioned problems. Further, by use of rigid circuit board circuitry and requiring logistically placed light hole openings, said devices create multiple garment manufacturing problems.

Yet another problem with known prior art is that physical constraints imposed by rigid circuitry limits component placement to portions of a garment not susceptible to consumer discomfort. For example, without regard to gender, only the front and back portions of a t-shirt provide suitable locations for placement of electrical circuitry. Placement at these locations minimize discomfort for bending is minimal. However, location of a rigid circuit board across an articulating surface such as an elbow, knee, ankle, neck, etc. . . . , is prohibitive due to stiffness associated with rigid components. Thus, circuitry is confined to certain locations which effectively limits its use to ornamental display.

No one heretofore has addressed the need for a multipurpose display device capable of operating as a safety device as well as an ornamental display. Nor has the prior art addressed a device that is water resistant, capable of placement over articulating surfaces, thin enough so as not to add bulk, or of such little weight that the consumer will not notice the circuitry when mounted on wearing apparel.

While efforts have been made toward resolving some of these problems, no satisfactory solution has heretofore been provided. My invention is specifically designed to overcome the aforementioned problems as well as meet the additional needs stated by use of a low cost, energy efficient, multipurpose optical display especially suited for articulating surfaces. It is, therefore, to the effective resolution of these needs and problems associated therewith that the present invention is directed.

SUMMARY OF THE INVENTION

The present invention is a highly effective optical lighting display device designed to fulfill the peculiar and special requirements of optical lighting when attached to wearing apparel requiring flexibility or articulation.

My multipurpose optical display has the efficacious of illuminating along the lines of wearing apparel that heretofore could not be effectively illuminated due to bending. In accordance with the invention, the optical display device is capable of securing to active limbs of a body in motion whereby body movement enhances optical display. The device consists of incandescent lamps, or the like, which are coupled to four wafer thin flexible strip circuit boards. Each circuit board utilizes eight lamps with a translucent shield placed on, or formed over, the length of the circuit board. The shield protects the lamps from moisture, impact, as well as provide a means for alternative color illumination. Lamp replacement is simplified by use of a removable shield placed over the lamps. The shield can be made of a variety of colors and design, and different shapes over each lamp such as tiny flowers, tiny animals, stars, spaceships and jewel shapes, rubies, diamonds, and emeralds and gemstone shapes and be changed at any time if a new or particular color combination is sought. In addition, the top of the circuit boards can be further coated with a reflective material such as a refractive foam, prismatic film or the like, for additional illumination.

Preferred placement of the device requires placement of a first flexible strip circuit board on each upper arm of the user and a second flexible strip circuit board positioned on the person's lower arm. Use of a low tack adhesive allows for releasably securement of each circuit board, while use of a high tack adhesive can be used to permanently bond the boards to wearing apparel. It should be noted that the use of adhesive in combination with a loop and pile fastener, mending the circuit board directly to the garment, or other attachment means is within the scope of this invention.

The upper and lower circuit boards are electrically coupled together by an accordion connector or other flexible connector means. Each upper circuit board is further coupled to a central control circuit by a similar connector means. The control circuit provides for energization of the lamps in a continuous, sequential, or random flashing mode with an adjustable potentiometer for variable flashing speed, stepping, random flashing, or strobe illumination by use of an integrated circuit.

By placement of my device on the arms of a consumer, the use of the optical display device is no longer limited to ornamental display purposes as the lamp location provides a heighten safety device for recreation, sporting, and professional purposes. For instance, bicyclists, skate boarders and joggers are but a few recreational sports that would benefit from having the operator highly illuminated. Police, groundsmen at airports, crossing guards are a few examples of professional uses of my device.

It should be understood that my device can be positioned on the legs, separated by the knees, or across any other tangible matter without regard to articulation where portable illumination is desired.

Numerous variations of the applicant's device is made possible by the coordination of electrical circuits, drivers, and covering means. For instance, one embodiment of the instant invention creates a product similar to the well known chemiluminescent novelty products. Chemiluminescent products are based on the reaction of catalyzed hydrogen peroxide with an oxalate producing the chemiluminescent light for use as brackets, necklaces, and light strips. Applicant's embodiments can be formed into any likeness of the chemiluminescent novelty products, but unlike chemiluminescent lights, applicant's products can be reused indefinitely. In addition, by use of integrated circuitry the applicant's device is capable of performing numerous functions not possible with the chemiluminescent or any other known prior art.

A programmable electrical embodiment utilizes 16 lamps that can made to light continuously or through various modes according to an EPROM IC chip stored program. Modes include: random lighting sequence, flashing lighting sequence, lighting lamps 1 to 16 in sequence, lighting lamps 16 to 1 in a reverse sequence, lighting lamps 8 to 1 and 9 to 16 in sequence, and lighting lamps 1 to 8 and 16 to 9 in a reverse sequences. Each mode can be changed by toggling of a switch. The speed of the sequencing lamps also changed by switch toggling the speed made adjustable from a few milliseconds to nearly two seconds.

Pictorial designs and shapes of the instant invention can be changed by use of translucent color changing covers. The covers can be made of flexible, semi-rigid, or rigid materials and made permanent or removable by spray, dip, dielectric encapsulated, for injection molding processes. Peel-off covers provide an instantaneous means of changing the device both in color and shape.

Another embodiment is the unique application of using Applicant's circuitry on patches that can be applied to a person's apparel and removed as easily as an adhesive patch. For example, the following scenes have been placed upon patches with the illuminating lights making the scene (no chip and few lamps would create "still" scenes and similar scenes surreal with a chip and many lamps will create active, moving scenes, "talling show" etc.)

1) Desert scene with a cactus, tumble weed, and desert sun;
2) Ocean scene with a palm trees with an ocean background;
3) Lightning scene with lightning and a rain storm;
4) Snow scene with skaters, snow storm, and snow man;
5) Flower scene with a flower, flower gardens;
6) Water falls and fireworks scenes.

The device is not limited by conventional circuit board design due to its low current draw. Substrates such as nylon, polyester, paper, and the like can be overlaid with conductive materials such as silver ink. An example of this use is the graphic t-shirt where the overlaying ink has conductive material placed within. Proper placement of the lamps permits graphic lighting design that is limited only by ones imagination (company names and logo, peoples first names, college and school names, and the olympic logos, and insignia).

Accordingly, it is the primary object of the present invention to provide an aesthetically pleasing, simple, and reliable optical display device capable of transcending articulating surfaces for safety and/or ornamental display purposes.

Another object of the present invention is to provide a means of placing incandescent lighting on a moving surface for the safety of bicyclists, joggers, children, pets or any other party who ventures during dusk.

Still another object of the invention is to provide incandescent lighting using a plurality of elongate rectilinear flexible circuit boards connected by an eight wire circuit whereby four of said eight wires are parallel connected.

Yet still another object of the invention is to provide incandescent lighting using a plurality of flexible circuit boards connected by a two wire circuit in a series parallel combination.

Another objective of the invention is to provide illumination enhancement to the base of flexible circuit boards by use of a reflective material.

Yet another objective of the invention is the use of shields to enshroud the lamps wherein each shield is made from a clear or colored translucent material, capable of diffuse refraction characteristics and further allow for ease of shield exchange or removal.

Another object of the invention is to provide a integrated circuit for control of continuous, adjustable sequential and random flashing by use of conventional chips.

Another objective of the instant invention is to provide a means for releasably securing a device to wearing apparel whereby the device is readily removed for apparel cleaning.

An object of the instant invention is to provide an electrical circuit having a preprogrammed memory for electronically changing functions modes and flashing speeds of the lamps.

Still another object of the invention is the use of electrically conductive ink in place of conventional flexible circuit boards for highlighting designer clothing (but conventional flex circuits can be used as well).

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is a front view of a jacket apparel with the invention mounted thereon;

FIG. 2 is a cross-sectional view of the light shield of the instant invention illustrating lamp and electrical connections thereto;

FIG. 3 is a top view illustrating light shield placement over lamp positions;

FIG. 4 is a top perspective view of the upper portion of an 8 wire flexible circuit strip;

FIG. 5 is a top perspective view of the lower portion of an eight wire flexible circuit strip;

FIG. 11 is a front view of the manual control mechanism for selection of on/off, sequential/run and speed of the light display;

FIGS. 29 through 37 show lighting displays according to the invention, utilizing the circuitry of FIG. 6 or FIG. 6A, which lighting displays are of different shape, and which are used removable, taped-on, color changes of the same shape for changing the appearance of the display;

DETAILED DESCRIPTION OF THE INVENTION

Figure 6:
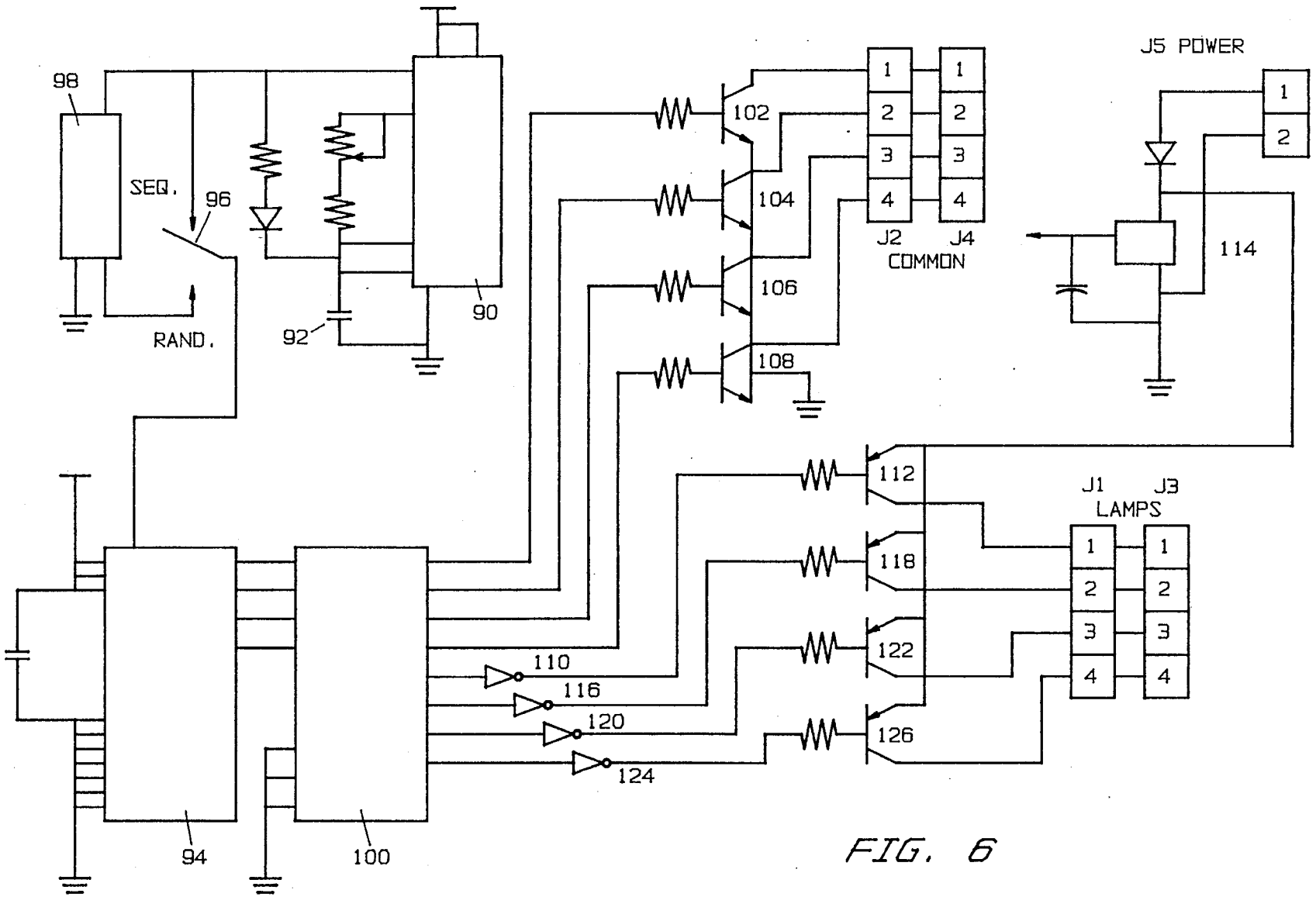
FIG. 6 is an electrical schematic of the eight wire circuitry of the invention.

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring to the drawings in more detail, FIG. 1 illustrates a typical piece of wearing apparel 10 for use by a consumer on which the device is mounted. Component location is distributed for optimum effect by placement on the arms with the control circuit centrally located. Per the illustration, central control circuitry 12 is logistically located between a first bank 14 of elongated rectilinear shaped flexible circuit boards and a second bank 16 of elongated rectilinear shaped flexible circuit boards, each bank a mirror image of the opposite bank. An accordion cable 18, between eight and twelve inches long in a closed position and twelve to twenty inches in an open position, couples the control circuitry 12 to an upper circuit board 20 of the first bank. A second accordion cable 22, between one to four inches long in a closed position and three to nine inches in an open position, couples the upper circuit board 20 to a lower circuit board 24. Each circuit board contains a plurality of incandescent lamps 26, the preferred embodiment being eight incandescent lamps placed equal distance along the length of each circuit board. Attention should be given to placement of the upper circuit board 20 in relation to the lower circuit board 24 in that each board resides on opposite sides of an articulating surface, in this instance the elbow joint 28.

The second bank 16 forms a mirror image of the first bank 14 by use of accordion cable 30 which couples the control circuitry 12 to an upper circuit board 32 of the second bank. A second accordion cable 34 couples upper circuit board 32 to lower circuit board 36. Each circuit board also contains a plurality of incandescent lamps 26 placed equal distance along the length of each circuit board. Each circuit board on each bank being between four and twelve inches long and 1/16 to one inch in width.

The preferred flexible circuit boards described above and throughout this specification are manufactured using copper which is bonded to kapton or mylar and chemically etched providing conductive pathways for the lamps. Alternatively, conductive ink such as METECH conductive silver ink #2521 or the like can be used to form the electrical pathways directly upon the apparel. The conductive ink can be used for the wearing apparel 10 of FIG. 1 wherein the first bank 14 and second bank 16 of flexible circuit boards are replaced with conductive ink. The ink bonding directly to the apparel surface. Fabrics constructed of cotton, silk, nylon, Dacron or the like porous materials, a substrate is first applied for printing the conductive ink paths. Suitable substrates are formed by the use of DuPONTS #5014 silkscreen printable substrate and dielectric surface or POLY FLEX CIRCUITS #PF200 silkscreen printable substrate and dielectric.

Figure 13:
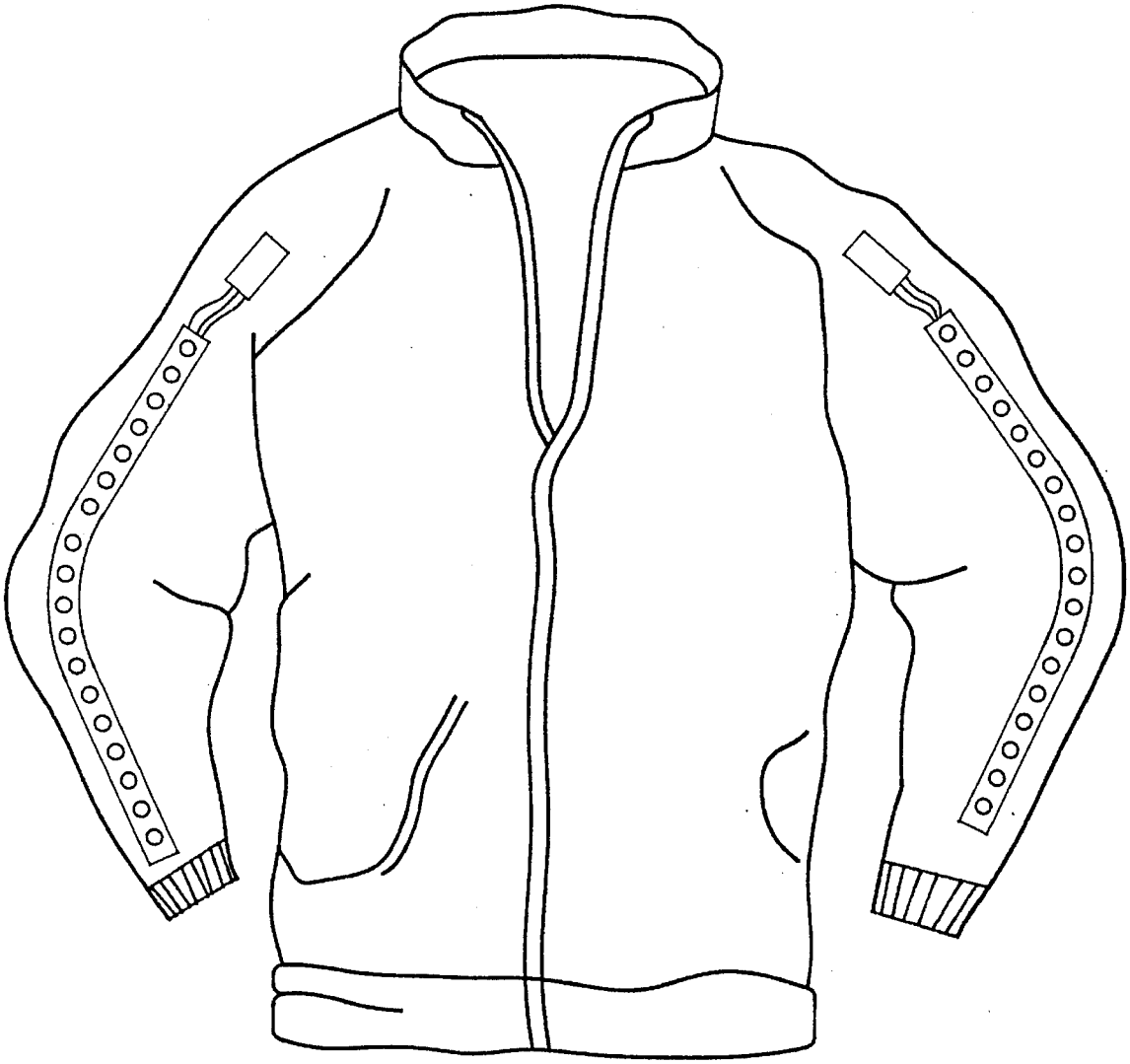
FIGS. 13 through 15 are schematic diagrams showing a jacket, pants, and shoe all made of printed on, conductive ink pathways (or flex circuit boards bonded to these items) for lightbulbs according to the invention.
Figure 14:
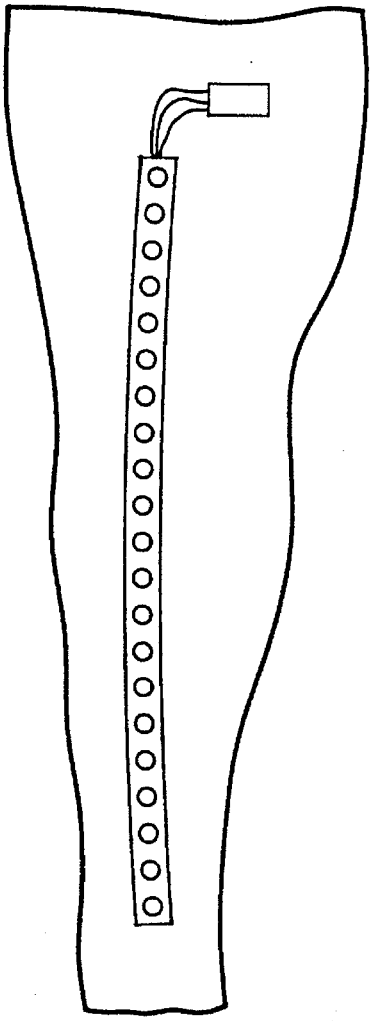
Figure 15:
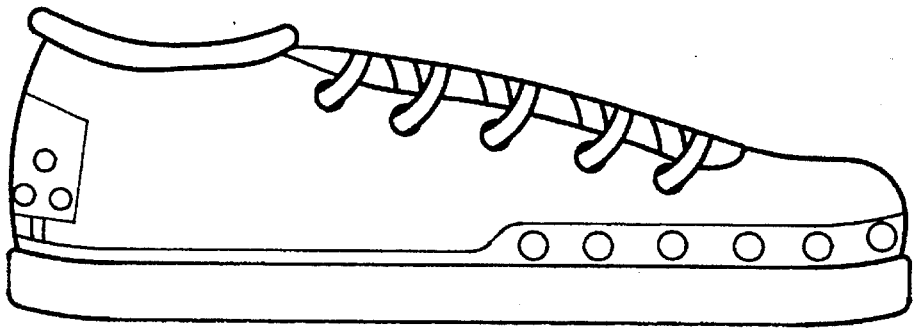
Figure 19:
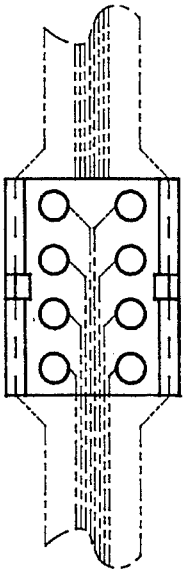
FIGS. 16 through 28 show various plastic clips for clamping together the ends of the flexible strips with the ends of the connectors, so that the ends are firmly, yet removably and electrically coupled together.
Figure 17:
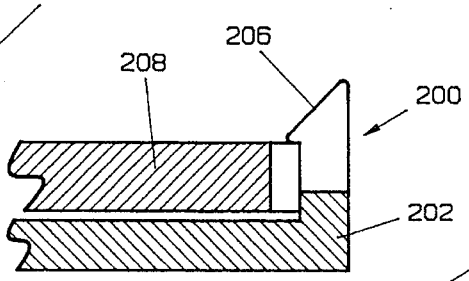

The conductive ink is useful for numerous applications requiring lightweight pathways formed into irregular patterns. For example, ink pathways are used in place of the aforementioned circuit boards and are especially useful for, but not limited to, custom t-shirt designs, flag highlighting, belts, hats, pants, neck ties, hair barrettes, umbrellas, hula hoops, wrist watches, batons, and beach balls to name but a few such uses, as seen in FIGS. 13 through 15, showing a jacket, pants, and shoe all made of conductive ink pathways, as described. Lamps can then be attached by electrically conductive epoxies or taped with adhesive transfer tape such as 3M's #9703 conductive tape. Silkscreen patterns are used in combination with the conductive pathways forming unique designs.

Now referring to the cross sectional view of FIG. 2, miniaturized lamps 26 such as unbased 5 volt incandescent lamps with a 0.200 mean spherical candle power (MSCP), are electrically coupled to flexible circuit board 38 by soldering or use of electrically conductive transfer adhesive tape 40 having low impedance in the thickness direction and very high impedance in the transverse direction such as 3M #9703. Use of conductive transfer adhesive tape eliminates need to solder lamps by tape placement over circuit board contacts allowing adhesive to become operatively associated to lamp leads 42. A layer of dual sided adhesive tape 44, or adhesive foam gasket, is then placed over the remaining portion of the circuit board allowing for the releasably coupling of translucent dome shaped shield 46. Shield 46 seals the lamps from moisture, damage, or accidental loosening of lamp leads. Shield 46 can be clear, colored, or have diffuse refraction characteristics. It should be noted that a flat shield, diamond shaped shield, or other conformal shape is deemed within the scope of this invention and is adjustable by use of appropriate sized adhesive 44. A reflective material 48 may be placed over the adhesive tape 44 to provide additional reflection qualities. Such a reflective material can be prismatic film, or the like, with adhesive qualities in and of itself. It should be noted that the use of LED's in place of lamps are permissible allowing shield installation by use of clear rubber coating sprayed on for a permanent finish.

Circuit board 38 is releasably secured to wearing apparel by use of pressure sensitive two sided tape or similar adhesive. Although not illustrated, another attachment means is use of high tack adhesive to permanently bond circuit boards to wearing apparel or use in combination with a loop and pile attachment. Yet another attachment means is use of holes inserted into the circuit boards allowing the boards to be sewn directly on the wearing apparel.

FIG. 3 illustrates a top view of a flexible circuit board having incandescent lamps 26 seen beneath shield 46. Lamp replacement is performed by lifting shield 46 from its adhesive attachment to access the problem lamp. Once a replacement lamp is installed, the shield 46 is simply placed back over the adhesive tape and pressed against the adhesive to create the bonding necessary for adherence. The shield can also be changed at any time for a new or different color combination by following the aforementioned procedures.

Now referring to FIG. 4, an eight wire simplified flexible circuit board 52 is shown. In this configuration the circuit board, referred to as the upper circuit board, employs a lead connector portion 54 for attachment to the control circuitry described in detail later in this description. Lead connector 60 is used to serially connect lamp positions A, B, C and D; connector 62 is used to serially connect lamp positions E, F, G and H; connector 64 is not lamp connected on the upper board and carries through to end connector 66; similarly connector 68 is not lamp connected on the upper board and carries through to end connector 70. Connector 72 is used to serially connect to lamp positions A, E, and end connector 74; connector 76 is used to serially connect to lamp positions B, F, and end connector 78; connector 80 is used to serially connect to lamp positions C, G, and end connector 82; connector 84 is used to serially connect to lamp positions D, H, and end connector 86.

The remaining six end connectors of the upper circuit board 52 are exposed in end connector portion 56 for corresponding coupling to end connectors of a lower circuit board 59. Coupling is performed by straight six wire accordion connector, not shown. The flexible accordion connector allows electrical current transfer over portions of a garment whose articulation is to severe for placement of even a flexible circuit board. The exposed contacts are copper pads with tin coating for moisture protection. For ease of assembling the accordion tape to the end connector portion, a piece of 3M #9703 electrical conductive transfer adhesive tape is placed over the end connector portion 56 of the upper circuit board 52. The flexible accordion connector is then placed over the conductive transfer adhesive tape whereby pressure sensitive adhesive physically bonds the connection and the electrically conductive particles within the conductive transfer adhesive tape provide a direct connection between end connector portion 56 and lead connector portion 58 of the lower circuit board 59. The accordion connector further connects 86 to 86' of FIG. 5; 70 connects to 70'; 66 connects to 66'; 82 connects to 82'; 78 connects to 78'; and 74 connect to 74'.

Now referring to FIG. 5 illustrating the lower circuit board 59 of the invention, it can be found that 66' is used to serially connects to lamp positions M, N, O, and P; 70' serially connects to lamp positions I, J, K, and L; 86' is used to serially connect L and P; 82' is used to serially connect K, and O; 78' is used to serially connect J, and N; and 82' is used to serially connect I, and M.

A second bank of flexible circuit boards, not shown, is formed in mirror image to the above mentioned first bank whereby the lead connector portions of each bank are made to a centralized control circuitry.

The circuitry of the preferred embodiment suitable for controlling the eight wire flexible circuit boards of FIGS. 4 & 5, and associated lamps, is shown in FIG. 6. In this IC chip based timing circuit, a conventional 555 IC timer 90 operates in an astable operation wherein it will trigger itself and free run as a multivibrator. External capacitor 92, 0.47 mfd, charges through resistors R1 and R2 which controls the duty cycle by ratio between R1 and R2, however, variable resistor VR1 operates as a potentiometer and by placement before R1 allows the operator to vary the frequency of the IC timer 90 pulse train. The pulse train is delivered directly to counter 94 when switch 96 is set placed in the "sequential" mode or the pulse train is made random by placing switch 96 in the "random" mode whereby digital noise 5437 source 98 creates a random pulse which is then delivered to counter 94. Counter 94 is a presettable up/down counter such as 4029 which can count in binary when binary/decade is at logical 1. A logical 1 present enable signal allows information at the jam inputs to preset the counter to any state asynchronously with the clock. The counter is advanced one count at the positive-going edge of the clock in the carry in and present enable inputs are at logical 0. The four bit output of counter 94 at Q0, Q1, Q2, & Q3 is delivered to conventional output decoder 100 such as a 4555 whereby output 9, 10, 11, 12 form a simultaneous common for the energization of lamps by use of 1-K OHM resistors R3, R4, R5, R6 each followed by NPN-2N4124 transistors 102, 104, 106 & 108 respectfully. The collector of each transistor is connected to the J2 and J4 common which in turn is connected to each bank of flexible circuit boards, the emitter is brought to sink. J2 terminal 1 is connected to contact 60 shown in FIG. 4; J2 terminal 2 is connected to contact 62; J2 terminal 3 is connected to contact 64; and J2 terminal 4 is connected to contact 68. J4 terminal forms a mirror image to a second upper circuit board (not shown).

Decoder 100 output 4 through 7406 inverter 110 to 1-K resistor R7 to PNP-2N4126 transistor 112 whose emitter is coupled to battery source 114 to power contacts 1 of J1 which in turn energize corresponding lamps D and H by connection to contact 84 shown on FIG. 4 and by use of contact 86 to 86' of FIG. 5 to energize corresponding lamps L and P. Stepping decoder 100 then outputs to 5 through inverter 116 to resistor R8 to PNP transistor 118 whose emitter is coupled to battery source 114 to power contacts 2 of J1 which in turn energize corresponding lamps C and G by connection to contact 80 shown on FIG. 4 and by use of contact 82 to 82' of FIG. 5 to energize corresponding lamps J and O. Stepping decoder 100 then outputs to 6 through inverter 120 to resistor R9 to PNP transistor 122 whose emitter is coupled to battery source 114 to power contacts 3 of J1 which in turn energize corresponding lamps B and F by connection to contact 76 shown on FIG. 4 and by use of contact 78 to 78' of FIG. 5 to energize corresponding lamps J and N. Finally decoder 100 outputs to 7 through inverter 124 to resistor R10 to PNP transistor 126 whose emitter is coupled to battery source 114 to power contacts 4 of J1 which in turn energize corresponding lamps A and E by connection to contact 72 shown on FIG. 4 and by use of contact 74 to 74' of FIG. 5 to energize corresponding lamps I and M. J3 contacts are coupled to the corresponding J1 contacts for control of the second bank of flexible circuit boards and mounted lamps, not shown, in a similar fashion. It should be recalled at this point that decoder 100 output is dependent upon position of sequential/random selector switch 96.

Figure 6A:
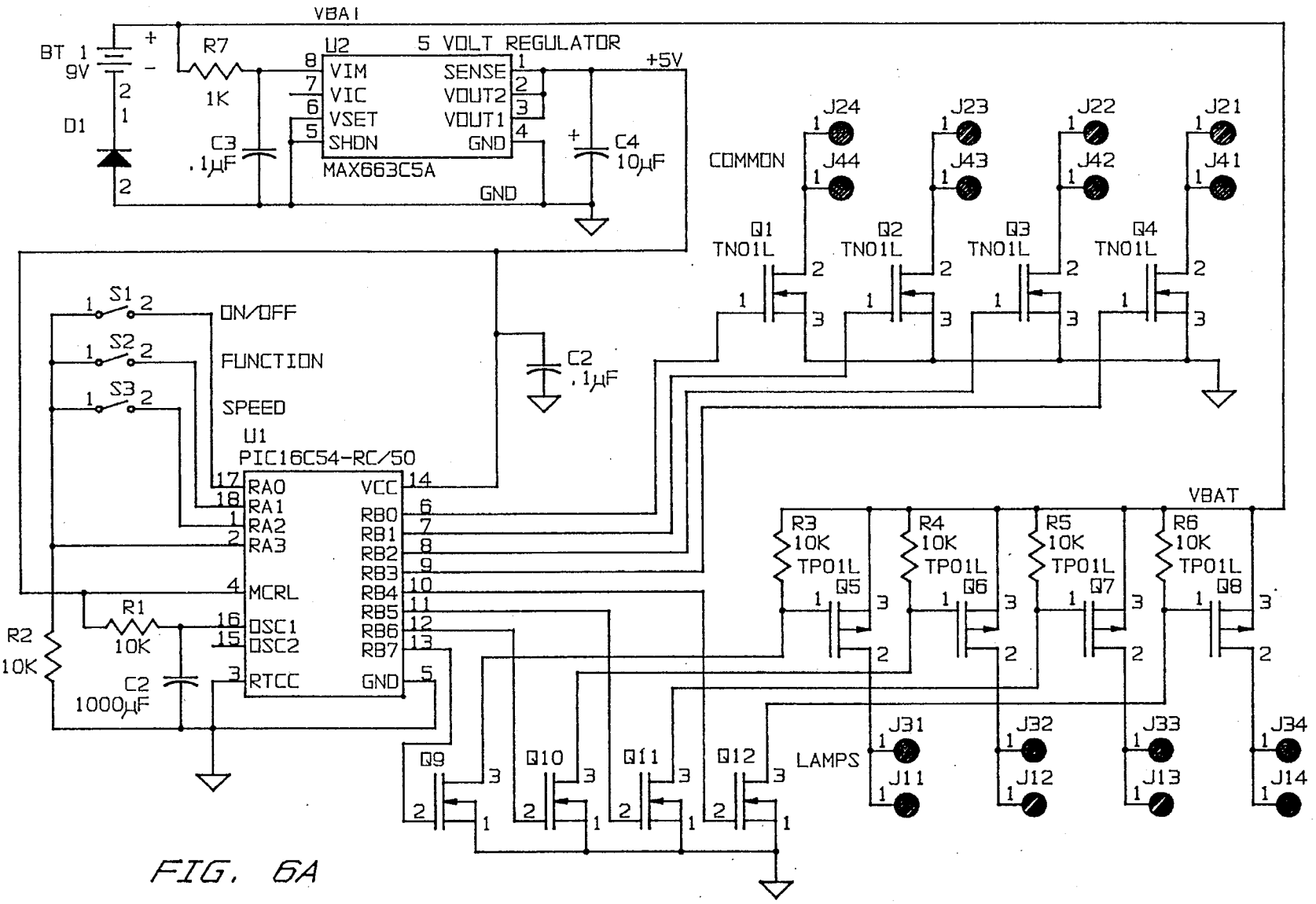
FIG. 6A is an alternative electrical schematic of the eight wire circuitry.

FIG. 6A is an alternative electrical embodiment wherein the IC chip based timing circuit is based on a MICROCHIP PIC16C54-RC/50. Battery source BT1 supplies a 5-volt regulator U2 such as a Maxim MAX663CSA by way of a 1K resistor R7 to VIN. Current sunk through a 0.1 uF capacitor C3 with 1 amp diode D1 electrically coupling the battery polarity to ground together with the Vset, Shdn, and ground pins of regulator U2. Voltage output from said regulator is 5 volts checked by 10 uF 6 volt tantalum capacitor C4 and 0.1 capacitor C2 providing a constant voltage to the microcontroller U1 the input pin VCC, master clear MCRL, and clock input through OSC1. The clock input from oscillator input pin OSC1 stepped by 10K resistor R1 and internally divided by four to generate non overlapping quadrature clocks. Upon power supply, the MCRL resets and the start-up timer begins counting once it detects MCRL to be high.

Oscillator input is electrically coupled to ground with real time clock/counter RTCC. Control of the microcomputer U1 is performed by three switches: on/off S1 read by input port RA0, function S2 read by input port RA1, and speed S3 read by input port RA2. Differential voltage provided by electrically coupling switches S1, S2, and S3 to port RA3 and ground through 10K resistor R2 with oscillator OSC1 biased by a 1000 pF capacitor C1. Thus, RA3 provides level of lighting flashes. Operation of the switches is for toggling a software program placed in a 12 bit wide on-chip EPROM, the software program provided in detail later in this specification.

Program output is provided through RM0 output to TNO1L transistor Q1 providing a parallel common for lamps J24 and J44, RB1 to TNO1L transistor Q2 providing a parallel common for lamps J23 and J43, RB3 to TNO1L transistor Q3 providing a parallel common for lamps J22 and J42, and RB4 to TNO1L transistor Q4 providing a parallel common for lamps J21 and J41, the transistors commonly brought to ground.

Lamp power is provide directly from the battery source BT1 to Lamps J11 and J31 through transistor TP01L Q5 used as a switch triggered by voltage difference provided from RB7 of U1 through MMBF170L transistor Q9 with 10K resistor R3 between Q9 output and voltage source BT1. Lamps J12 and J32 are provided voltage through transistor TP01L Q6 used as a switch triggered by voltage difference provided from RB6 of U1 through MMBF17OL transistor Q10 with 10K resistor R4 between Q10 output and voltage source BT1. Lamps J13 and J33 are provided voltage through transistor TP01L Q6 used as a switch triggered by voltage difference provided from RB5 of U1 through MMBF170L transistor Q11 with 10K resistor R5 between Q11 output and voltage source BT1. Lamps J14 and J34 are provided voltage through transistor TP01L Q8 used as a switch triggered by voltage difference provided from RB6 of U1 through MMBF170L transistor Q12 with 10K resistor R6 between Q12 output and voltage source BT1.

The instant invention provides a unique method of manufacturing wearing apparel with optical display capability. For example, the conductive silver ink can be applied to a t-shirt or other apparel in a predetermined pattern from which a plurality of lamps are electrically coupled forming a conductive pathway. The control circuitry of the instant device is then connected to the pathway providing control for illumination of the lamps. If the apparel is made of a porous material, a substrate can be added to the apparel permitting acceptance of the conductive ink. The IC chip may include an erasable programmable read on memory preprogrammed to control the illumination of the lamps by the following steps:

(a) preparing a set of instructions based upon six separate function modes in a language compatible with said EPROM;

(b) loading said EPROM with said instructions;

(c) providing a single switching means for accessing each of said function modes;

(d) executing said instructions stored in said EPROM upon toggling of said switching means;

(e) interpreting said instructions for sequencing of said illumination means according to the accessed function mode.

The software program for the EPROM of the microcontroller U1 is written in Assembly Language and follows in this specification. Port A is used for reading the switches, Port B is used to control the lamps.

```
SwOnOff      equ  00h  ;Port_A bit 0, (RA0)
SwMode       equ  01h  ;Port_A bit 1, (RA1)
SwSpeed      equ  02h  ;Port_A bit 2, (RA2)
SwLevel      equ  03h  ;Port_A bit 3, (RA3), hi or lo to sw
SwStatus     equ  09h  ;saved current status of switches
SwDebounce   equ  13h  ;delay time switch debounce
SpState      equ  0Ah  ;last saved state for speed switch
                       ;bit 0 of SpState: is Swspeed pressed
                       (1
                       ; or now released (0)
                       ;bit 1 of SpState used to toggle,
                       ; increase speed(1) or decrease speed
                       (0)
```

The preferred embodiment for circuit design uses an RC oscillating frequency of 76.2 KHz. This provides a cycle clock of 52.49 microseconds. Thus, with RTCC prescaler set to 1:128 and 0<=DelayCnt<=255, the flash speed adjustable between a few milliseconds and 1.7 seconds maximum. Software program for EPROM

```
;------------------------------------------------------------------------
;   Mode 1 Random Lighting Sequence
;------------------------------------------------------------------------
Mode_1
            movf    Mode1Rand, w
            movwf   Temp3           ;store copy of last random number
md10        rlf     Mode1Rand, w
            movwf   Temp
            rlf     Temp, w
            movwf   Temp            ;Temp = Mode1Rand shl 2
            rlf     Temp, w
            movwf   Temp2           ;Temp2 = Mode1Rand shl 3
            rlf     Temp2, w        ;w     = Mode1Rand shl 4
                                    ;in W, bit 3 now is in bit 7 position.
            xorwf   Mode1Rand, w
            xorwf   Temp, w
            xorwf   Temp2, w
```

-continued

```
            bcf     STATUS, C           ;clear carry
            rlf     Mode1Rand, Same     ;now shift our seed.
            andlw   80h                 ;set Z as result of xor bits 7, 5, 4 an
            skpz                        ;shift xor result into LSB.
md11        incf    Mode1Rand, Same     ;make LSB = result of them xors
            movf    Mode1Rand, w
            bz      md11                ;avoid 0 state
            movwf   Mode1Save           ;save for next time.
            btfss   Mode1Rand, 7
            xorlw   0Fh                 ;if msb = 0 then invert
            movwf   Temp
            xorwf   Temp3, w            ;test if it's same number as last time.
            andlw   0Fh
            bz      md10                ;if same, get new random number.
            movf    Temp, w
            andlw   0Fh                 ;number lights 0 thru 15
            call    Mode1Tbl
            xorlw   Notbyte             ;invert nibble
            movwf   Port_B              ;output new light sequence
            goto    Delay               ;delay and check switches
Mode1Tbl                                ;add w to PC --> PC
            addwf   PC,Same             ;update PC to vector into lookup table
            ;nibble RB7-RB4 is columns, clr bit to lite
            ;nibble RB3-RB0 is rows, set bit to lite
            retlw   01111000b           ;light #0, RB7(col) & RB3(row) active
            retlw   10111000b           ;light #1
            retlw   11011000b           ;light #2
            retlw   11101000b           ;light #3
            retlw   01110100b           ;light #4
            retlw   10110100b           ;light #5
            retlw   11010100b           ;light #6
            retlw   11100100b           ;light #7
            retlw   01110010b           ;light #8
            retlw   10110010b           ;light #9
            retlw   11010010b           ;light #10
            retlw   11100010b           ;light #11
            retlw   01110001b           ;light #12
            retlw   10110001b           ;light #13
            retlw   11010001b           ;light #14
            retlw   11100001b           ;light #15
-----------------------------------------------------------------------
    Mode 2 Flashing Lighting Sequence
-----------------------------------------------------------------------
Mode_2
            movlw   11111111b           ;all on
            movwf   Port_B              ;output new light sequence
            movlw   PreScaler           ;set for 1:128
            option                      ;load prescaler for RTCC
            movlw   Mode2Cnt            ;on time.
            call    Wait                ;wait while lights are on.
            movlw   00000000b           ;all off
            movwf   Port_B              ;output new light sequence
            goto    Delay               ;delay and check switches
-----------------------------------------------------------------------
    Mode 3 Lighting Sequence            0 to 16 sequence
-----------------------------------------------------------------------
Mode_3
            movf    Mode3Step, w        ;current step in lighting sequence to do
            andlw   0Fh                 ;steps = 0 thru 15, if > 15, reset to 0
                                        ;mask off top 4 bits
            movwf   Mode3Step
            call    Mode3Tbl
            xorlw   Notbyte             ;invert nibble
            movwf   Port_B              ;output new light sequence
            incf    Mode3Step, Same     ;next step in lighting sequence to do
            goto    Delay               ;delay and check switches
-----------------------------------------------------------------------
    Mode 4 Lighting Sequence (reverse of Mode 3)   16 to 0 sequence
-----------------------------------------------------------------------
Mode_4                                  ;this used to use Mode4Step.
            movf    Mode3Step, w        ;current step in lighting sequence.
            andlw   0Fh                 ;steps = 0 thru 15, if > 15, reset to 0
                                        ;mask off top 4 bits
            movwf   Mode3Step
            call    Mode3Tbl
            xorlw   Notbyte             ;invert nibble
            movwf   Port_B              ;output new light sequence
            decf    Mode3Step, Same     ;next step in lighting sequence to do
            goto    Delay               ;delay and check switches
Mode3Tbl
```

-continued

```
            addwf   PC,Same             ;update PC to vector into lookup table
            ;-------------------------------------------------------------
            -------
            ;nibble RB7–RB4 is columns, clr bit to lite
            ;nibble RB3–RB0 is rows, set bit to lite
            retlw   01111000b           ;Mode3Step = 0, RB7(col) & RB3(row) acti
            retlw   10111000b           ;Mode3Step = 1
            retlw   11011000b           ;Mode3Step = 2
            retlw   11101000b           ;Mode3Step = 3
            retlw   01110100b           ;Mode3Step = 4
            retlw   10110100b           ;Mode3Step = 5
            retlw   11010100b           ;Mode3Step = 6
            retlw   11100100b           ;Mode3Step = 7
            retlw   01110010b           ;Mode3Step = 8
            retlw   10110010b           ;Mode3Step = 9
            retlw   11010010b           ;Mode3Step = 10
            retlw   11100010b           ;Mode3Step = 11
            retlw   01110001b           ;Mode3Step = 12
            retlw   10110001b           ;Mode3Step = 13
            retlw   11010001b           ;Mode3Step = 14
            retlw   11100001b           ;Mode3Step = 15
-----------------------------------------------------------------------
    Mode 5 Lighting Sequence            7 to 0, 8 to 16 sequence
-----------------------------------------------------------------------
Mode_5
            movf    Mode5Step, w        ;current step in lighting sequence to do
            andlw   0Fh                 ;steps = 0 thru 15, if > 15, reset to 0
                                        ;mask off top 4 bits
            movwf   Mode5Step
            call    Mode5Tbl
            xorlw   Notbyte             ;invert nibble
            movwf   Port_B              ;output new light sequence
            incf    Mode5Step, Same     ;next step in lighting sequence to do
            goto    Delay               ;delay and check switches
Mode5Tbl
            addwf   PC,Same             ;update PC to vector into lookup table
            ;-------------------------------------------------------------
            -------
            ;nibble RB7–RB4 is columns, clr bit to lite
            ;nibble RB3–RB0 is rows, set bit to lite
            retlw   11100100b           ;Mode5Step = 0, RB7(col) & RB3(row) acti
            retlw   11010100b           ;Mode5Step = 1
            retlw   10110100b           ;Mode5Step = 2
            retlw   01110100b           ;Mode5Step = 3
            retlw   11101000b           ;Mode5Step = 4
            retlw   11011000b           ;Mode5Step = 5
            retlw   10111000b           ;Mode5Step = 6
            retlw   01111000b           ;Mode5Step = 7
            retlw   01110010b           ;Mode5Step = 8
            retlw   10110010b           ;Mode5Step = 9
            retlw   11010010b           ;Mode5Step = 10
            retlw   11100010b           ;Mode5Step = 11
            retlw   01110001b           ;Mode5Step = 12
            retlw   10110001b           ;Mode5Step = 13
            retlw   11010001b           ;Mode5Step = 14
            retlw   11100001b           ;Mode5Step = 15
-----------------------------------------------------------------------
    Mode 6 Lighting Sequence (reverse of Mode 5)
-----------------------------------------------------------------------
Mode_6
            movf    Mode6Step, w        ;current step in lighting sequence to do
            andlw   0Fh                 ;steps = 0 thru 15, if > 15, reset to 0
                                        ;mask off top 4 bits
            movwf   Mode6Step
            call    Mode6Tbl
            xorlw   Notbyte             ;invert nibble
            movwf   Port_B              ;output new light sequence
            incf    Mode6Step, Same     ;next step in lighting sequence to do
            goto    Delay               ;delay and check switches
Mode6Tbl
            addwf   PC,Same             ;update PC to vector into lookup table
            ;-------------------------------------------------------------
            -------
            ;nibble RB7–RB4 is columns, clr bit to lite
            ;nibble RB3–RB0 is rows, set bit to lite
            retlw   11100001b           ;Mode6Step = 0, RB7(col) & RB3(row) acti
            retlw   11010001b           ;Mode6Step = 1
            retlw   10110001b           ;Mode6Step = 2
            retlw   01110001b           ;Mode6Step = 3
            retlw   11100010b           ;Mode6Step = 4
            retlw   11010010b           ;Mode6Step = 5
```

-continued

```
                retlw   10110010b       ;Mode6Step = 6
                retlw   01110010b       ;Mode6Step = 7
                retlw   01111000b       ;Mode6Step = 8
                retlw   10111000b       ;Mode6Step = 9
                retlw   11011000b       ;Mode6Step = 10
                retlw   11101000b       ;Mode6Step = 11
                retlw   01110100b       ;Mode6Step = 12
                retlw   10110100b       ;Mode6Step = 13
                retlw   11010100b       ;Mode6Step = 14
                retlw   11100100b       ;Mode6Step = 15
*****************************************************************
   Main             ;resides in code space address < 0FFh
*****************************************************************
Main
                clrwdt                  ;reset timer
                movf    Mode,w          ;current mode sequence to be performed
                xorlw   2               ;These 4 lines were added at the last
                btfss   STATUS, Z       ;minute to skip the all flash mode 2.
                goto    Main2           ;
                incf    Mode,Same       ;do this line if Mode = 2. Do mode 3 ins
Main2           movf    Mode,w          ;current mode sequence to be performed
                andlw   07h             ;mask off top 5 bits, error precaution
                addwf   PC,Same         ;update PC to vector to desired mode rou
                goto    Mode_Off        ;Mode = 0,  turn all lights off
                goto    Mode_1          ;Mode = 1   random
                goto    Mode_2          ;Mode = 2   all flash
                goto    Mode_3          ;Mode = 3   0 to 16    <------
                goto    Mode_4          ;Mode = 4   16 to 0    ------>
                goto    Mode_5          ;Mode = 5   outward    <--  -->
                goto    Mode_6          ;Mode = 6   inward     --> <--
                goto    Error           ;Mode = 7
-----------------------------------------------------------------
   Delay and Check Key Switches
-----------------------------------------------------------------
Delay
                clrf    RTCC            ;reset to 0
                movlw   PreScaler
                option                  ;load prescaler for RTCC
                movlw   00h             ;RB0–RB7 are outputs
                tris    Port_B
DelayChk
                clrwdt                  ;reset watchdog timer
                movf    RTCC, w
                subwf   DelayCnt, w
                btfss   STATUS, C       ;test carry (if reset then overflowed)
                                        ; skip if RTCC <= DelayCnt
                                        ; and go on to SwitchChk
                goto    Main
                btfss   STATUS, Z       ;if zero also timed-out
                goto    SwitchChk
                ;timed-out, RTCC == DelayCnt, need to make sure that each cycle
                ;does the current Mode routine at least once and the SwitchChk
                ;routine at least once
                movlw   DelayMax        ;if DelayCnt too big, go do Mode routine
                subwf   DelayCnt, w     ; w = f – w = DelayCnt – Delaymax
                btfsc   STATUS, Z       ; if w>f then cy=0, goto SwitchChk
                goto    Main            ;jmp if DelayCnt = DelayMax
                call    ReadSW          ;SwStatus is set there
                bnz     SwNotActive     ;else check below
                btfsc   SwStatus,SwOnOff ;SwStatus read only here (gm)
                goto    TurnOff         ;go off
                btfsc   SwStatus,SwMode ;if not SwMode, than change speed
                goto    ModeChange
                goto    SpeedChange
*****************************************************************
   Subroutines (reside in lower EPROM address 000–0FF)
*****************************************************************
                ORG     0
-----------------------------------------------------------------
   Mode_Off
-----------------------------------------------------------------
Mode_Odd
                movlw   00h             ;set for all lights off
                movwf   Port_B
                movlw   00h             ;RB0–RB7 are outputs
                tris    Port_B
                movlw   Offh            ;inputs
                tris    Port_A
                clrf    RTCC
                movlw   0Eh
```

-continued

```
                option
                clrwdt                  ;go to sleep for about 1 second.
                nop
                sleep                   ;go into power down mode for 18 ms
                                        ; the WDT will time-out and do reset
;
                                        ;note: can't use prescaler for WDT
                                        ;here since sleep command clears
                                        ;the prescaler value!
Turnoff
                movf    Mode, w
                movwf   ModeSave        ;save last mode sequence
                clrf    Mode            ;set for Mode_Off = go to sleep.
                goto    Main
ModeChange
                ;-----------------------------------------------------------
                -------
                ;increment value in Mode, so next mode becomes active
                incf    Mode, Same
                movlw   07h
                subwf   Mode, w         ;don't allow Mode = 7, (invalid)
                btfsc   STATUS, Z
                incf    Mode, Same      ;Mode was 7, now = 8
                movlw   07h
                andwf   Mode, Same      ;mask, now 0 <= Mode <= 6
                btfsc   STATUS, Z       ;don't allow Mode = 0, (Mode_Off)
                incf    Mode, Same      ;now 1 <= Mode <= 6
;               clrf    Mode3Step       ;start each mode sequence at 1st positio
;               clrf    Mode4Step
                clrf    Mode5Step
                clrf    Mode6Step
                goto    Main            ;skip debounce loop.
SpeedChange
                                        ;bit 0 of SpState: was Swspeed pressed (
                                        ;or released (0)
                                        ;bit 1 of SpState: increase speed (1) wa
                                        ;last state or decrease speed (0) was
                                        ;last state
                btfsc   SpState, 0      ;if Swspeed was just newly pressed then
                goto    SpeedAdjust     ;toggle increase or decrease
                btfsc   SpState, 1
                goto    Speed1
                bsf     SpState, 1
                goto    SpDebounce
Speed1          bcf     SpState, 1
SpDebounce
                ;delay here for switch debounce, only if SwSpeed newly pressed
;               movlw   PreScaler       ;set for 1:128
;               option                  ;load prescaler for RTCC
;               movf    SwDebounce,w
;               call    Wait            ;This isn't necessary any more.
;
                bsf     SpState, 0      ;SwSpeed has been pressed and still mayb
                                        ;pressed, if it has been released then
                                        ;SwNotActive routine will clr SpState bi
                goto    Main
SpeedAdjust
                movlw   8d              ;if DelayCnt < 8d then make SpeedStep =1
                subwf   DelayCnt, w     ; make the speed adjust procedure use ex
                btfsc   STATUS, C       ; cycles for easier fast speed adjustmen
                goto    SpeedStep1
                movf    SpeedStep, Same ;move thru w to test
                btfss   STATUS, Z
                goto    SpeedCycle1
                decfsz  SpeedCycle, Same
                goto    SpeedState
                incf    SpeedStep, Same ;set SpeedStep back to 1
                goto    SpeedState
SpeedCycle1
                clrf    SpeedStep
                movlw   15d
                movwf   SpeedCycle
                goto    SpeedState
SpeedStep1
                movlw   25d             ;if DelayCnt < 25d then make SpeedStep =
                subwf   DelayCnt, w     ; for easier fast speed adjustment
                btfsc   STATUS, C
                goto    SpeedStep2
                movlw   01h
                movwf   SpeedStep
```

-continued

```
                goto    SpeedState
SpeedStep2
                rrf     DelayCnt, w         ;divide by 2
                movwf   Temp
                rrf     Temp, w             ;divide by 2
                andlw   3Fh                 ;truncate, <=63
                movwf   SpeedStep
SpeedState
                btfsc   SpState, 1          ;speed up or slow down?
                goto    SpeedIncr
                movf    SpeedStep, w        ;slow down.
                addwf   DelayCnt, Same      ;decrease speed by increasing delay coun
                movlw   DelayMax
                subwf   DelayCnt, w         ; w = f – w = DelayCnt – DelayMax
                bnc     SpeedDelay          ; if w>f then cy=0. skip if Cnt < Max.
                movlw   DelayMax            ; if carry set, Cnt > Max so limit to Ma
                movwf   DelayCnt            ; set DelayCnt = DelayMax.
                goto    SpeedDelay
SpeedIncr
                movf    SpeedStep, w
                subwf   DelayCnt, Same      ;increase speed by decreasing delay coun
                btfss   STATUS, C
                goto    SpeedIncr1
                btfss   STATUS, Z
                goto    SpeedDelay
SpeedIncr1
                movlw   00h                 ;if carry reset (= overflow)
                movwf   DelayCnt            ; set DelayCnt = 0 for now, change latte
SpeedDelay
                clrwdt                      ;reset watchdog timer
                movf    RTCC, w
                subwf   DelayCnt, w
                btfss   STATUS, C           ;test carry (if reset then overflowed)
                                            ; skip if RTCC <= DelayCnt
                goto    Main                ;timed-out
                btfss   STATUS, Z           ;if zero also timed-out
                goto    SpeedDelay
                movf    DelayCnt, w
                iorlw   0                   ;if DelayCnt = 0, make for smaller dela
                btfss   STATUS, Z
                goto    Main
                                            ;set up RTCC prescaler for 1:32 instead
                                            ; the usual 1:128 for shorter delay
                                            ;this will allow for better fast speed c
                                            ; rather than using no delay at all
                movlw   PreScaler1
                option                      ;load prescaler for RTCC
                movlw   02h
                call    Wait
                goto    Main
SwNotActive
                ;-----------------------------------------------------------
                -------
                bcf     SpState, 0          ;bit 0 of SpState used for keeping
                                            ;track, is Swspeed pressed(1) or
                                            ;now released (0)
                movf    DelayCnt, w
                xorlw   00h                 ;if DelayCnt = 0, make for smaller dela
                btfss   STATUS, Z
                goto    DelayChk
                                            ;set up RTCC prescaler for 1:32 instead
                                            ; the usual 1:128 for shorter delay
                                            ;this will allow for better fast speed c
                                            ; rather than using no delay at all
                movlw   PreScaler1
                option                      ;load prescaler for RTCC
                movlw   02h                 ;cycle 3 times, (1:32) × 3 = 96 < (1:128
                call    Wait
                goto    main
-----------------------------------------------------------------------
    Error Routine
-----------------------------------------------------------------------
Error           goto    Error               ;loop until WDT times out and resets
***********************************************************************
    Initialization (Reset Entry Point)
***********************************************************************
Init
-----------------------------------------------------------------------
    Set Up RTCC (prescaler assigned to RTCC)
-----------------------------------------------------------------------
```

-continued

```
                movlw   0                       ;set for all lights off
                movwf   Port_B
                movlw   0                       ;RB0–RB7 are outputs
                tris    Port_B
                clrf    SpState                 ; Set Up Default Values
                clrf    SwStatus
                clrf    Mode3Step
                clrf    Mode4Step
                clrf    Mode5Step
                clrf    Mode6Step
                movlw   DebounceCnt
                movwf   SwDebounce
                ;-----------------------------------------------------------
                -------
                ;check if reset was from power-up (TO=1, PD=1) or from WDT
                ;wake-up from sleep (TO=0, PD=0) or from WDT time-out (not
                ;during sleep, error condition), (TO=0, PD=1)
                ;if power-up reset, or WDT time-out reset (error condition)
                ; then set defaults
                ;if WDT wake-up reset then just use previously used settings
                btfss   STATUS, PD
                goto    Mode_Off_Chk            ;it's a reset from WDT wake-up
                movlw   DefltMode               ;POWER UP RESET!     or error
                movwf   Mode
                movwf   ModeSave
                movlw   DefltCnt
                movwf   DelayCnt
                goto    Turnoff                 ;When battery is connected, enter off st
Mode_Off_Chk
                ;-----------------------------------------------------------
                -------
                ;reset is WDT wake-up, so the unit is currently in
                ;Off Mode, so check the SwOnOff button to see if active
                ;(is user trying to turn unit back on?)
                ;if on/off switch active, continue
                ;else goto Mode_Off and return to sleep
                movlw   0                       ;RB0–RB7 are outputs
                tris    Port_B
                movlw   1                       ;test on/off switch
                call    SWcheck
                bnz     Mode_Off                ;switch not closed, stay asleep
-----------------------------------------------------------------------
  TurnOn                ;start running last used mode sequence and
-----------------------------------------------------------------------
                        ;speed setting before it was turned off
                clrwdt
                movlw   PreScaler               ;load prescaler for RTCC
                option
                movf    ModeSave, w
                movwf   Mode                    ;restore last mode sequence used
                goto    Main
*****************************************************************
  Reset Entry Vector
*****************************************************************
                ORG     PIC54
                goto    Init
                END
```

Watchdog timer, WDT, is a free running on-chip RC oscillator that runs even when the clock on the OSC1 pin is stopped such as by the sleep instruction.

Another embodiment of the device is a two wire circuit which utilizes an IC timer and power supply mounted at a remote location with a two wire transfer to each flexible circuit board wherein a hybrid chip is locally mounted for acutally control of the lamps. Now referring to FIG. 7, a two wire flexible circuit board 130 is shown. In this configuration the circuit board, referred to as the upper circuit board, employs a lead connector 132 and 134 for attachment to the two wire timer and power control circuitry described in detail later in this description. Lead connector 134 provides pulse input to the hybrid chip circuit and carries to end connector 136. Lead connector 132 serially connect common side of lamp positions AA, BB, CC, DD, EE, FF, GG, HH, and carries to end connector 138. Lamp energization is by individual wire to each of said lamp positions by operation of the hybrid chip described later in this embodiment.

Coupling is performed by straight two wire accordion or flexible connector, not shown. The flexible accordion connector allows electrical current transfer over portions of a garment whose articulation is to severe for placement of even a flexible circuit board. Coupling provides a direct connection between end connector portion 136 and lead connector portion 136' of the lower circuit board 140 shown in FIG. 8. The connector further connects 138 to 138'. Now referring to FIG. 8, in this configuration the circuit board 140, referred to as the lower circuit board, employs a lead connector 136' to serially connect common side of lamp positions II, JJ, KK, LL, MM, NN, OO, and PP. Lead connector 138' is from the two wire timer and power control circuitry for pulse input to the board mounted hybrid chip circuit.

A second bank of flexible circuit boards, not shown, forms a mirror image to the above mentioned first bank whereby the lead connector portions of each bank are made to a centralized control circuitry.

Figure 7:
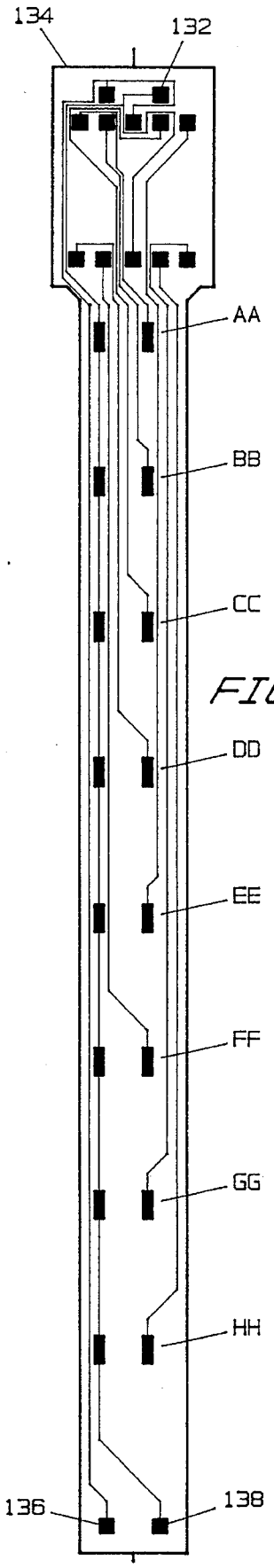
FIG. 7 is a top perspective view of the upper portion of the two wire flexible circuit strip.
Figure 8:
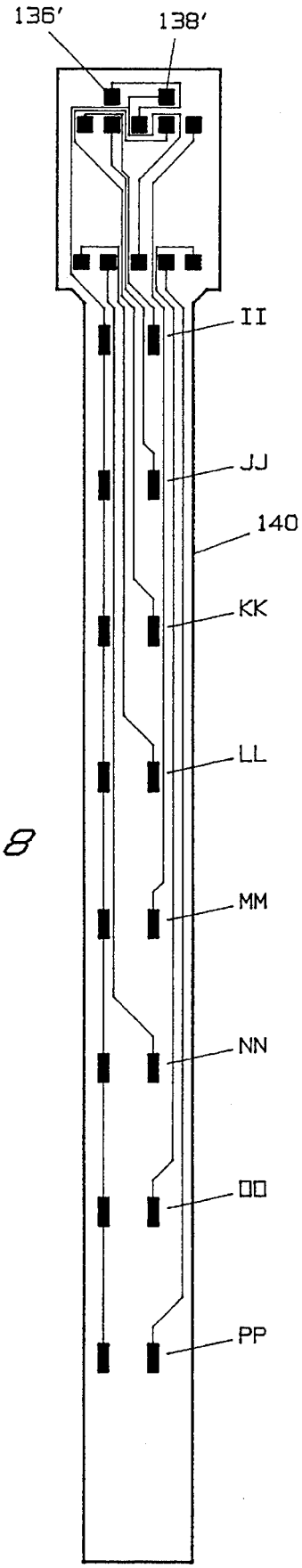
FIG. 8 is a top perspective view of the lower portion of a two wire flexible circuit strip.
Figure 9:
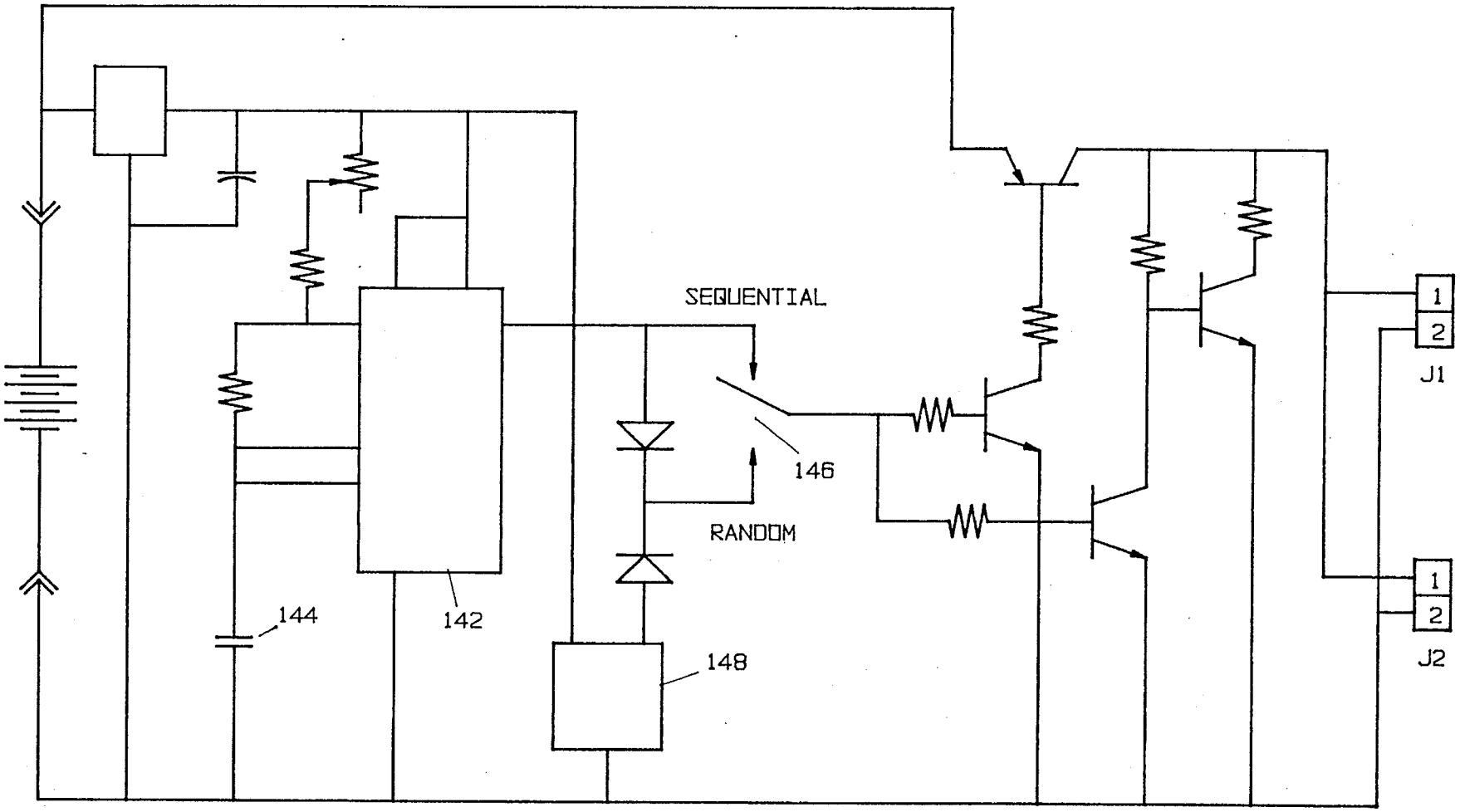
FIG. 9 is an electrical schematic of the two wire power supply circuitry of the invention.

The circuitry of the two wire suitable for pulse input of hybrid circuits for control of flexible circuit boards shown in FIGS. 7 & 8, and associated lamps, is shown in FIG. 9. In this IC chip based timing circuit, a conventional 555 IC timer 142 operates in an astable operation wherein it will trigger itself and free run as a multivibrator. External capacitor 144, 0.47 mfd, charges through resistors R1 and R2 which controls the duty cycle by ratio between R1 and R2, with variable resistor VR1 operating as a potentiometer by placement before R1 to allow the operator to vary the frequency of the IC timer 142 pulse train. The pulse train is delivered to NPN PN2222 transistor Q1 through 10K ohm resistor R3 and to NPN PN2222 transistor Q2 through 10K ohm resistor R4 when switch 146 is placed in the "sequential" mode. The pulse train is made random by placing switch 146 in the "random" mode whereby digital noise 5437 source 148 creates a random pulse in combination with D1N914 diode D1 and D1N914 diode D2 before delivery to transistors Q1 and Q2. Q1 operates in conjunction with Q4 for voltage supply to contact 1 of J1 and J2. Q2 operates in conjunction with Q3 for voltage supply to contact 2 of J1 and J2. J1 is connected to the PWR contact of FIG. 10 by use of a connector wire, not shown. J2 is connected to the GRN contact of FIG. 10 by use of a connector wire, not shown.

Figure 10:
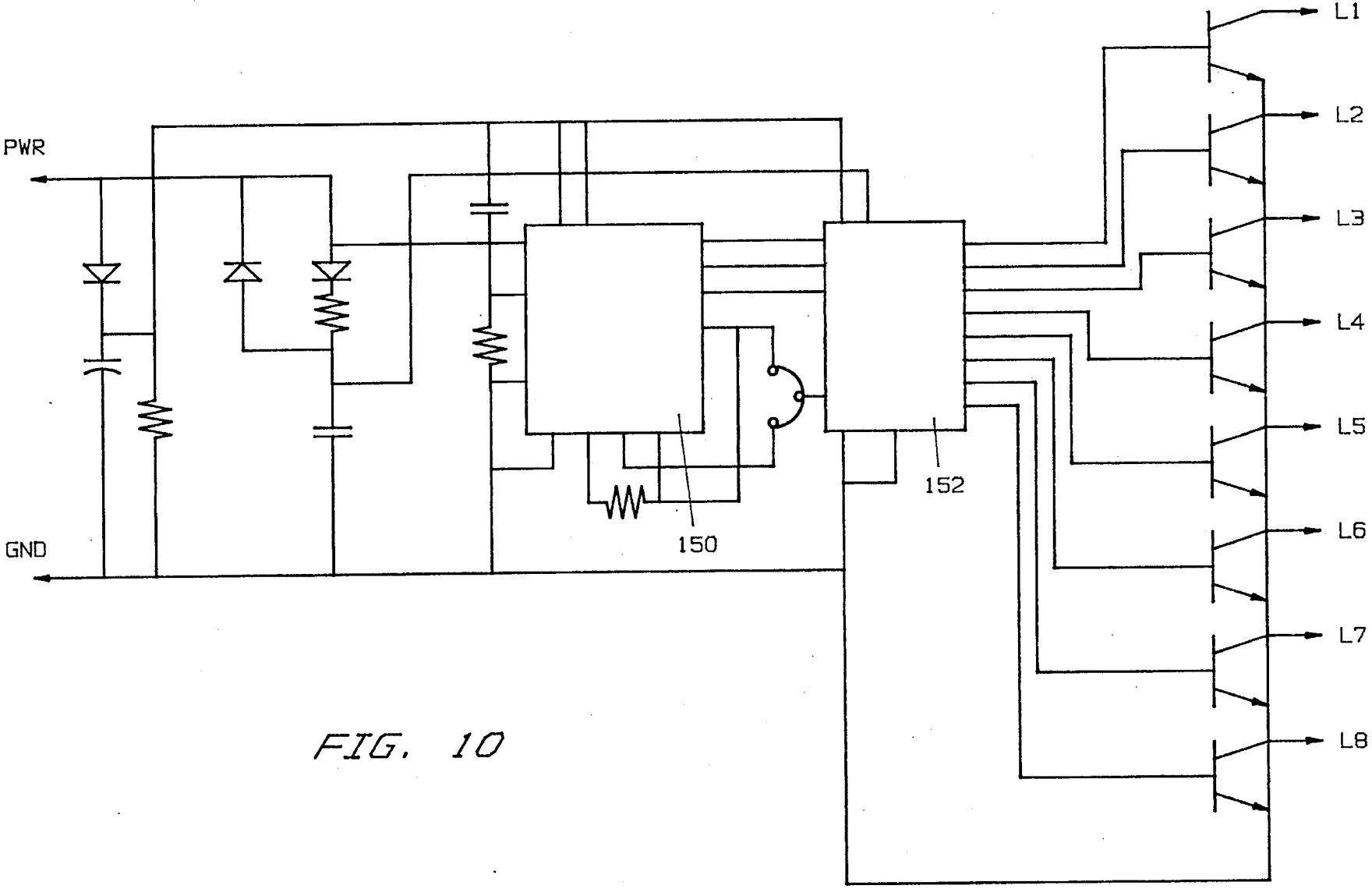
FIG. 10 is an electrical schematic of the two wire strip board mounted hybrid chip circuitry of the invention.

Now referring to FIG. 10, the control circuitry mounted on the first end of each flexible board for control of eight lamps per board. Employing a dual synchronous counter 150 as a conventional 4520 in which pulse train is delivered directly to CL pin 1; to EN pin 2 and pin 16 by after diode D1 in which capacitor C1 and resistor R2 sink to ground. Ground pin 8 and CL pin 9 are coupled to ground, RST pin 7 connected to ground by resistor R3 with voltage applied through capacitor C3. Pins 3, 4, 5 and 6 follow the 1-2-4-8 binary code with output changing state synchronously. Pin 6 is coupled to RST pin 15 for the count to reset and to EN pin 10 for advancement of the second portion of the dual counter after resistor R4, pin 6 is further connected to switch JP1. Pin 11 of the dual counter, first output of the dual counter, is also delivered to switch JP1.

The four output of the first half of the counter, or depending on JP1 switch location, the first three outputs and the first counter and the first output of the second counter, is connected to a 1-OF-8 switch 152 such as an 4051 multiplexer. Pin 7 and 8 are grounded, Pin 3 is used as an input from the power circuit after diode D1, D2 and resistor R2 with capacitor C2 to ground. Pin 16 is coupled to pin 16 of counter 150 for voltage. When INH pin 6 of switch 152 is low the channel selected is determined by the binary input from counter 150 to pin 9=C, pin 10=B, and pin 11=A, pulse signal is then distributed by pin 13=1 to transistor 2N4124 of lamp L1, pin 14=2 to transistor of lamp L2, pin 15=3 to transistor of lamp L3, pin 12=4 to transistor of lamp L4, pin 1=5 to transistor of lamp L5, pin 5=6 to transistor of lamp L6, pin 2=7 to transistor of lamp L7, and pin 4=8 to transistor of lamp L8.

The control circuit may be as complicated as that shown in first embodiment of FIG. 8, or second embodiment of FIG. 9 and 10, or it can be as simple as an on/off circuit with or without a timing mechanism.

FIG. 11 illustrates the manual control switch whereby switch 160 completes connection to the power supply, switch 162 operates switch 96 on FIG. 8, switch 146 on FIG. 9, for control of random or sequential timing. Switch 164 operates the variable resistor VR1 of FIG. 8, VR1 of FIG. 9.

Figure 12:
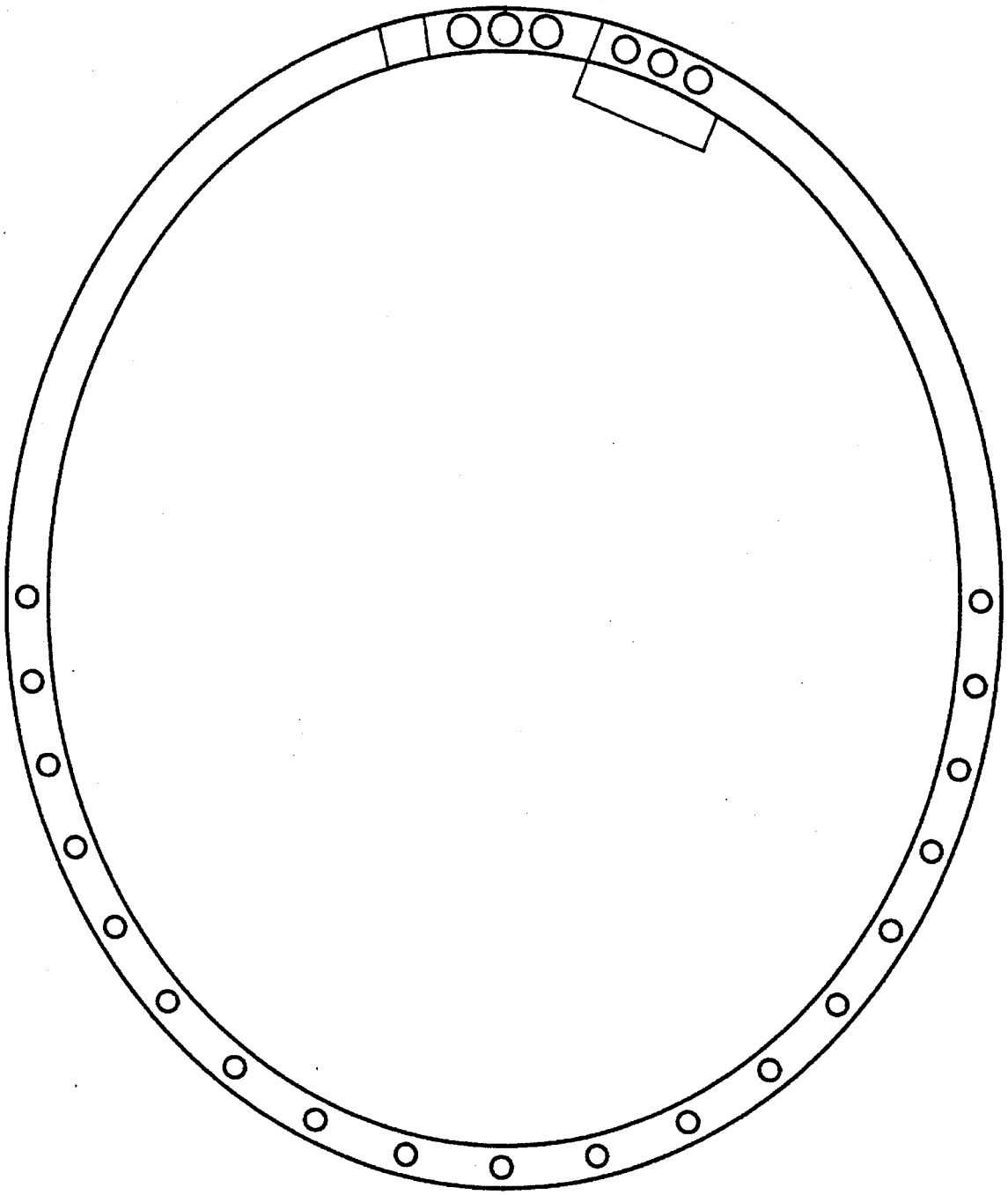
FIG. 12 is a top view of a necklace illustrating the control mechanism for selection of on/off, mode, and speed of the EPROM driven electrical circuit.

Now referring to FIG. 12, shown is a necklace having the control circuitry of the alternative embodiment wherein the necklace 180 has a base structure of material such as paper, cloth, leather, nylon or the like with a conductive pathway formed similar to FIG. 6. Illumination means includes a plurality of lamps 182 located around the necklace with the control circuit 184 located at an accessible portion hidden by the wearer's neck. The control circuit having an on/off switch 186, mode switch 188, and speed switch 190. The 9-volt power supply obtained by three 3-volt button batteries placed in series. The necklace fastened by attachment device 192. Although the necklace embodiment is shown, similar circuitry can be placed on objects as small as a persons ring and as large as a hula hoop.

Figure 16:
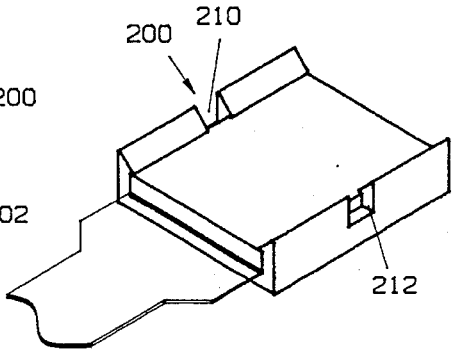
Figure 18:
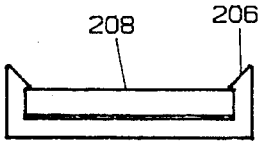

Referring to FIGS. 16 through 28, there are shown various plastic clips for clamping the ends of the strips 20, 24, 32, 34 with the ends of the connectors 18, 22, 30, 34, so that the ends are firmly, yet removably coupled together. The clips are used on the ends after the electrically conducting tape, or the equivalent thereof, have been applied to electrically connect respective ends together. In FIGS. 16–19, a clip 200 has a bottom part 202 with a pair of upstanding side walls 204, each of which defines an elongated beaded member 206 for receiving in a snap-fit manner a top closure-member 208, whereby the top and bottom parts are clamped together. The distance between the two side walls 204 is slightly greater than the width of the electrical tape and the ends of the strips or connectors. As seen in FIG. 16, before clamping the two parts together, the ends of the respective banks and connectors are placed on the top surface of the bottom part 202, with the two adjoining ends then taped together with electrical conducting tape, as if to splice them together, as described above, and then the top part 208 is clamped in place. The ends of the strips and connectors are then firmly held in place for all movements of the person, with the electrical conducting tape being prevented from disconnection. A pair of notches, or cutouts, 210, 212 are provided in the upstanding side walls 204, by which one may insert an instrument for disassembling the top and bottom parts 202, 208 form each other, when so desired, as when storing the device.

Figure 20:
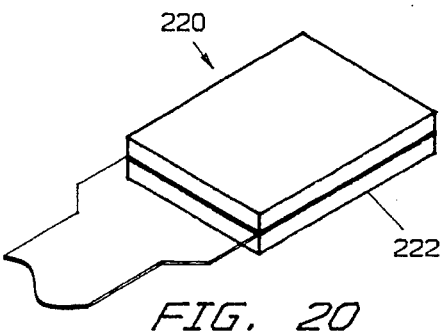
Figure 23:
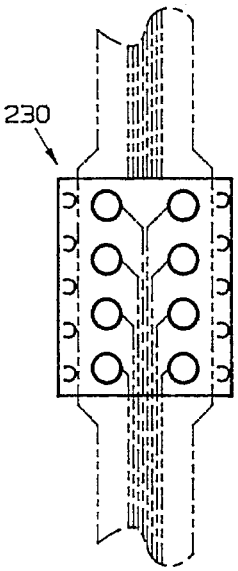
Figure 21:
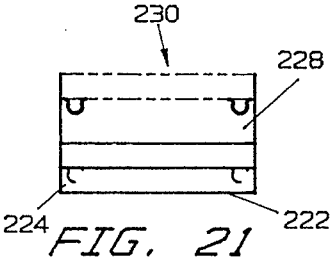
Figure 22:
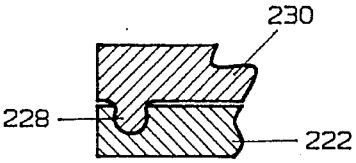

In FIGS. 20–22, a modified clip 220 is shown which is similar to the clip 200, but with the difference that instead of the vertical side walls and retaining bead of the clip 200, the clip 220 has a bottom part 222 having a plurality of holes 224 formed in the lateral side edge surfaces of the top surface thereof, in which holes are received prongs, or snaps, 228 of a top part 230, which prongs are placed on the lateral side edges of the bottom surface of the upper part 230, for mating with the holes 224. The distance between the linear strips of holes or the linear strips of prongs is greater than the width of the electrical tape and ends of the strips and connectors.

Figure 24:
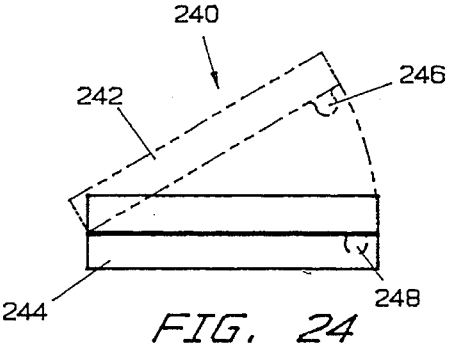
Figure 25:
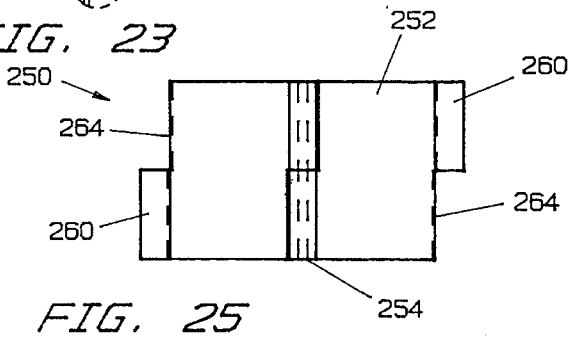

FIG. 24 shows a slight modification 240 of the clip 220 where a top part 242 is pivotally, and integrally, connected to a bottom part 244 along mutual side edges to provide a clam-shell type of clamp. The free edges are provided with prongs 246 and holes 248 similar to those of the clip 220. However, only one side edge is provided with the respective plurality of prongs or holes. The pivotal connection between the two parts is preferably constituted by a living hinge.

Figure 26:
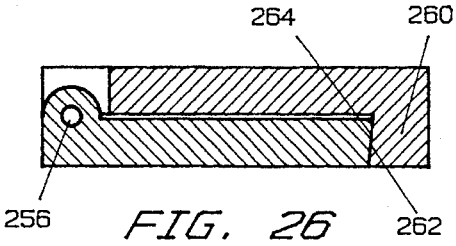
Figure 27:
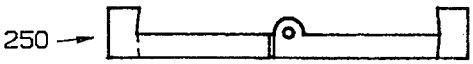
Figure 28:
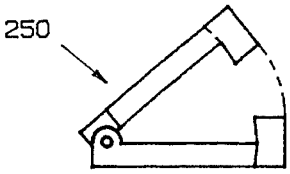

FIGS. 25–28 show yet another version 250 of the clip. In this modification, the clip 250 is made up of two identical halves 252. Each half 252 has a tubular member 254 projecting from one end through which passes a pivot pin 256 for pivotally mounting the two halves together, with each tubular member 254 only extending half of the width of the respective half, so that when the two are combined, one long tube is formed for receiving the pivot pin 256. From the other end of each half projects a latching member 260, for cooperating with the edge surface of the other half. As can be seen in FIG. 26, the inwardly-facing surface 262 is slightly canted for mating with the similarly-canted surface face 264 of the other half's edge surface for removably retaining the two halves together by a snap fit as one forces the two halves together by rotating them toward each other about the pivot pin 256 and slightly forcing the bottom edges of the canted surfaces 262 past the upper ends of the canted surfaces 64.

FIGS. 29 through 37 show lighting displays according to the invention, used for decoration, display, etc., utilizing the circuitry of FIG. 6 or FIG. 6A, which lighting displays are of different shape, and which are used removable, taped-on, color changes of the same shape for changing the appearance of the display. FIGS. 29 and 30 show a triangular lighting display 300 having electrically-conductive ink circuitry 302 printed thereon (or conventional flex circuits with copper or kapton, mylar) with light bulbs 304 strategically placed. FIG. 29 shows the front surface, on which only light bulbs 304 are visible, while FIG. 30 shows the rear surface 308 with through holes for grounding. A series of different color-changers 310 also of the same, triangular shape are provided for removable, taped-on attachment to the front surface 308. Each color-changer 310 is made up of series of triangles, one inside the other, to form a plurality of concentric, annular triangles. The color changer 310 is made colored translucent plastic, so that the light from the bulbs 304 is visible. The color changer 310 is removably secured to the front surface 308 by means of double-sides stick tape 312 on the front surface and on the rear surface of the color changer itself, so that one color changer 310 may be replaced with a different color changer of different color. Also, each annular triangle of the color changer 310 may itself be of a different color from the other annular triangles of the same color changer 310. The number of different color changes and the colors within each color changer's triangles may, of course, vary. To replace one color changer with a differently colored one, one simply removes the one already applied by pulling it off and applying the new one via the double-sided stick tape thereof.

Figure 36:
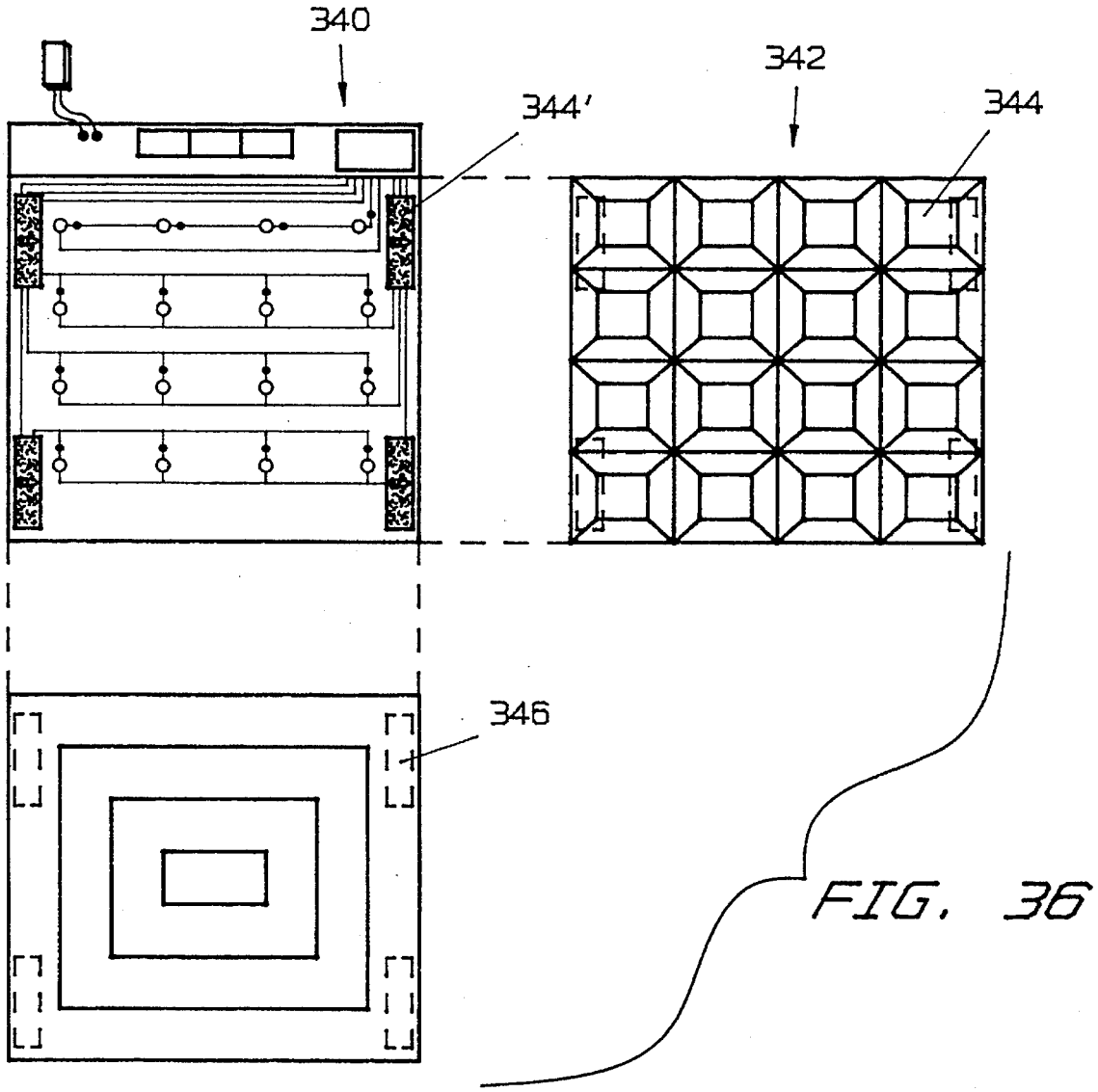
Figure 37:
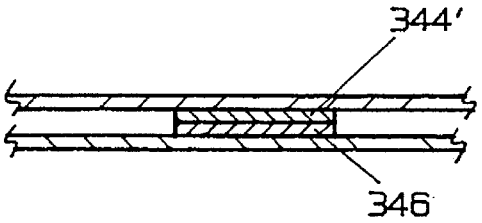

FIGS. 32–35 show another lighting display 320 that is basically circular in configuration, with a circular color changer 322 being used. The circular color changer 322 has concentric circles to match the circular shape of the display. FIGS. 36–37 show a square-shaped display 340, with a color changer 342 made up of a plurality of rows and columns of square-shaped domes 344. FIG. 37 shows the double-side stick tape 344, 346 for removably securing each color changer to the display board.

Figure 40:
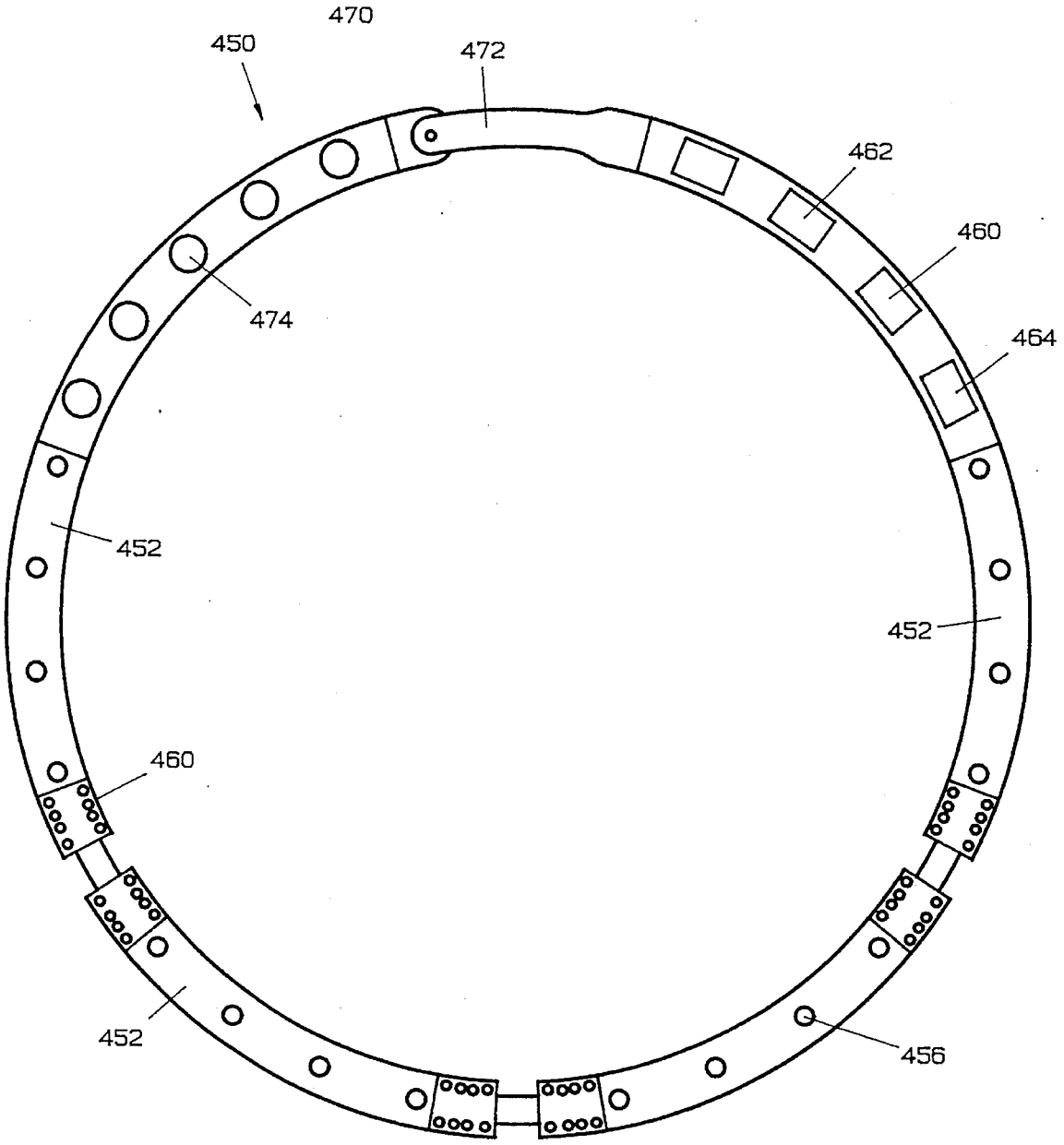
FIGS. 38 through 41 show items jewelry made according to the invention.
Figure 38:
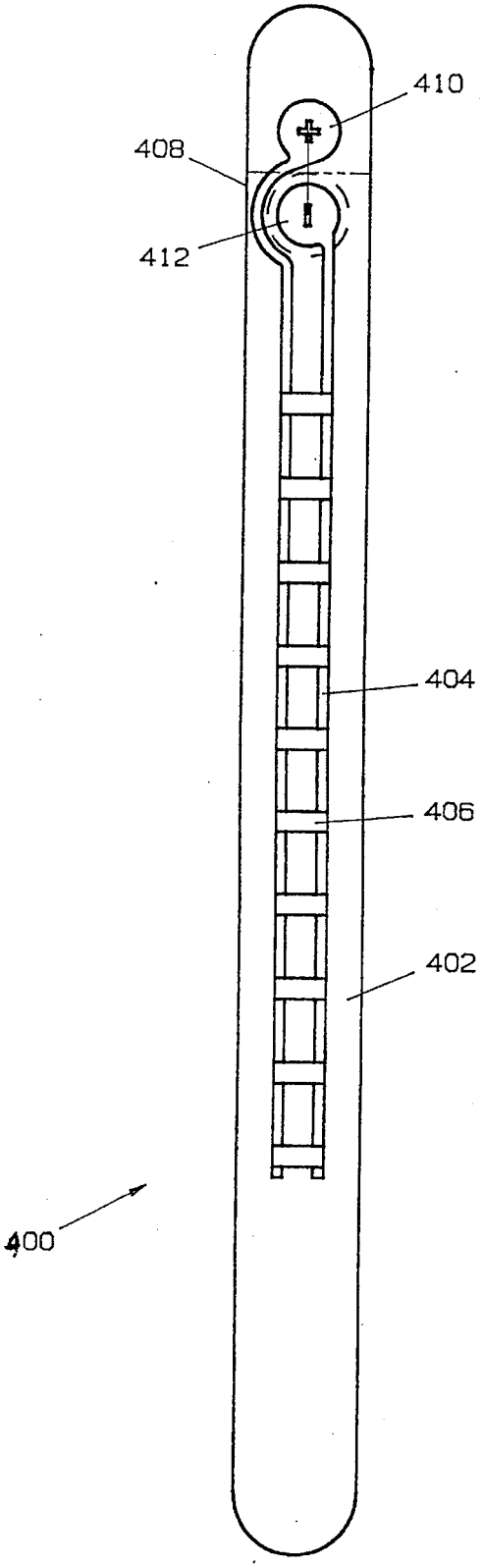
Figure 39:
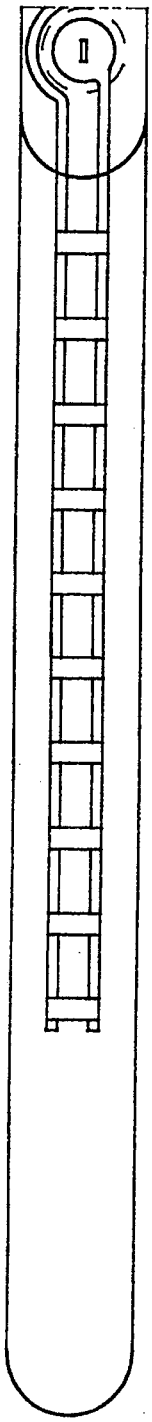
Figure 39A:
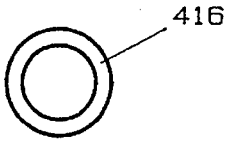

FIGS. 38–41 show use of the lighting array and method thereof for forming items of jewelry, such as a bracelet seen in FIGS. 38–39 or necklace of FIG. 40. In FIGS. 38 and 39, a bracelet 400 is made of an elongated member 402 of paper, mylar, or even a fabric. Silk-screened onto the member 402 are electrical conductive paths 404 in which are placed bulbs or LED's 406, in the same manner as described above for the versions applied directly onto a garment, or the like. Alternatively, copper paths may be bonded directly onto mylar, also previously described above with regard to FIG. 1. A dielectric coating is placed over all of the conductive paths except for a large round area 408 where a round battery is placed. A final clear encapsulation is then sprayed over the LED's. One end of the member 402 has a first, round positive conductive area 410, and a second, round negative conductive area 412. The member 402 is folded in the area between these two areas 410,412, as seen in FIG. 39. In between these folded over areas 410, 412 is placed a conventional, round, 3 volt, lithium battery. To ensure that the battery is firmly held in place, and that the two electrodes 410, 412 are firmly held against the terminals of the battery, a double-stick tape gasket 416 is placed about the electrode area 412. Within the hollow interior of the gasket 416, the lithium battery is placed. The gasket ensures that the folded over parts of the end of the member 402 remain secured to each, so that electrical contact between battery and electrodes occurs. When it is desired to9 shut of the lights, one simply unfolds the folded-over area against the adhesive holding forces of the gasket 416, and then one removes the battery. In order to removably secure the bracelet 400 about a wrist, mating hook-and-pile fasteners are placed on the ends of the member 402. Of course, other conventional fastening means may be employed.

FIG. 40 shows a similar jewelry item 450 used as a necklace. In this version, a number of arcuate-shaped printed-circuit members or sections 452 are used, on each of which is silk-screened electrical conductive paths, as above described. The material may be flexible paper, fabric, or mylar. Each member 452 may be similar to those disclosed in FIGS. 1–5, with the members 452 being arcuate rather than linear. Each section 452 has LED's or bulbs 456, and are interconnected by clips 460, like those shown on FIGS. 16–28. Appropriate controls are provided, such as speed control switch 460, mode control 462, sequential random mode control 464, and the like, as described above. Any version of the control circuitry described above may be used. Two adjoining ends 470, 472 of two sections are provided with conventional cooperating fasteners for securing the necklace about a person's neck. This necklace may also be used as a pet collar for cats or dogs. A plurality or series-connected 1.5 or 3.0 volt batteries 474 are placed in a section 452. The batteries and controls are preferably provided near the cooperating fasteners so that they are hidden from view when the necklace is worn, so that only the lighting display is visible. In a modification of the necklace 450, just one circular member may be used instead of individual links, or sections, 452. The jewelry items may also be, provided in smaller size for serving as a ring with lighting display.

Figure 41:
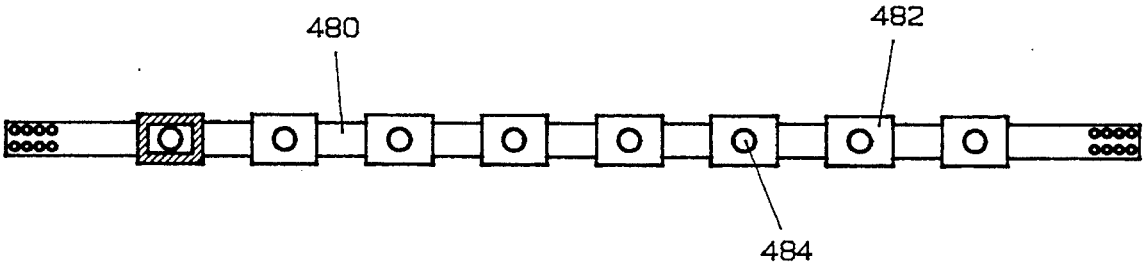

FIG. 41 shows a modification of the jewelry items, in which the elongated base member, such as members 402 or 452 are formed into a geometric pattern for aesthetic appearance. For example, each member may be an elongated strip 480 interspersed with larger square-shaped sections 482 in which are placed the LED's or bulbs 484. Of course, different shapes may be employed.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A method of manufacturing wearing apparel with optical display capability comprising the steps of:

(a) printing an electrically conductive pathway having a predetermined pattern directly onto said apparel;

(b) electrically coupling a means for illumination onto said conductive pathway;

(c) connecting a control circuitry for the energizing of said illumination means, said control circuitry comprising a semi-flexible circuit board having an IC chip based timing circuit, and having a power source for illuminating said illumination means;

said control circuit being coupled to said illumination means by means of said electrically conductive pathway.

2. The method of manufacturing according to claim 1, wherein the pathway of step (a) is comprised of conductive ink.

3. The method of manufacturing according to claim 2, wherein the use of a conductive pathway comprised of ink includes the step of applying a substrate to said apparel if said apparel is a porous material, said substrate having silkscreen printable characteristics.

4. The method of manufacturing according to claim 3, wherein the conductive ink is defined as a silver conductor ink.

5. The method of manufacturing according to claim 1, wherein step (b) includes releasably attaching a plurality of translucent cover means for coloration of said illumination means.

6. The method of manufacturing according to claim 1, wherein the IC chip of step (C) includes an erasable programmable read only memory.

7. The method of manufacturing according to claim 6, wherein the EPROM is preprogrammed to control the illumination means comprising the steps of:

(a) preparing a set of instructions based upon six separate function modes in a language compatible with said EPROM;

(b) loading said EPROM with said instructions;

(c) providing a single switching means for accessing each of said function modes;

(d) executing said instructions stored in said EPROM upon toggling of said switching means;

(e) interpreting said instructions for sequencing of said illumination means according to said function mode.

8. The method of manufacturing according to claim 7, wherein said six separate function modes are defined as:

(1) instructions to said illumination means for flashing a plurality of lamps in random order;

(2) instructions to said illumination means for flashing all said lamps simultaneously;

(3) instructions to said illumination means for flashing said lamps in a repeatable upward sequential manner;

(4) instructions to said illumination means for flashing said lamps wherein step (3) is reversed;

(5) instructions to said illumination means for flashing said lamps in a split sequential manner, said split causing one half of said lamps to flash in a repeatable downward sequential manner while a second half of said lamps to flash in a repeatable upward sequential manner;

(6) instructions to said illumination means for flashing said lamps in a reverse split sequential manner wherein step (5) is reversed.

9. The method of manufacturing according to claim 7, wherein the EPROM includes a watchdog timer that is manually adjusted to sequence said illumination means between a few milliseconds and 1.7 seconds.

* * * * *